United States Patent [19]

Tomczak et al.

[11] 4,252,098

[45] Feb. 24, 1981

[54] AIR/FUEL RATIO CONTROL FOR AN INTERNAL COMBUSTION ENGINE USING AN EXHAUST GAS SENSOR

[75] Inventors: Lawrence W. Tomczak, Rochester; John R. Vorndran, Sterling Heights, both of Mich.

[73] Assignee: Chrysler Corporation, Highland Park, Mich.

[21] Appl. No.: 932,587

[22] Filed: Aug. 10, 1978

[51] Int. Cl.[3] ..... F02B 33/00

[52] U.S. Cl. ..... 123/437; 123/445; 123/446

[58] Field of Search ..... 123/119 EC, 32 EE, 32 EA, 123/32 EB; 364/431; 60/276, 285

[56] References Cited

U.S. PATENT DOCUMENTS

| | | | |
|---|---|---|---|
| 4,073,269 | 2/1978 | Herth et al. | 123/32 EE |
| 4,088,095 | 5/1978 | Aono | 123/119 EC |
| 4,094,186 | 6/1978 | Wessel | 123/32 EE |
| 4,099,491 | 7/1978 | Reddy | 123/32 EA |
| 4,103,649 | 8/1978 | Matumoto et al. | 123/32 EE |
| 4,103,695 | 8/1978 | Aono | 123/119 EC |
| 4,107,920 | 8/1978 | Minami et al. | 123/119 EC |
| 4,111,162 | 9/1978 | Normatsu et al. | 123/119 EC |
| 4,111,171 | 9/1978 | Aono et al. | 123/32 EE |
| 4,112,880 | 9/1978 | Asano et al. | 123/119 EC |
| 4,121,554 | 10/1978 | Sueishi et al. | 123/32 EE |
| 4,122,811 | 10/1978 | Bowler et al. | 123/119 EC |
| 4,130,095 | 12/1978 | Bowler et al. | 60/276 |
| 4,134,375 | 1/1979 | Koseki et al. | 123/119 EC |
| 4,142,482 | 3/1979 | Asano et al. | 123/119 EC |
| 4,153,022 | 5/1979 | Asano et al. | 123/119 EC |

*Primary Examiner*—Charles J. Myhre
*Assistant Examiner*—Raymond A. Nelli
*Attorney, Agent, or Firm*—Newtson & Dundas

[57] ABSTRACT

The invention is disclosed in the preferred embodiment as an electronic feedback carburetor system wherein, in the closed-loop mode of operation, an oxygen sensor monitors the oxygen concentration of the exhaust gases and supplies a signal to an electronic control unit which in turn causes a command signal to be supplied to the carburetor for adjusting the air/fuel ratio to a commanded value. The electronic control unit contains unique circuitry which selectively provides closed-loop and open-loop modes of operation depending upon the condition of other input signals to the electronic control unit. The circuitry contains integrator and stability circuits which are both utilized in the closed-loop mode to develop from the oxygen sensor signal a composite signal which provides for closely regulated control of the air/fuel ratio about a desired operating point at or in the vicinity of stoichiometric. This composite signal provides, in response to a change in state of the oxygen sensor, a predetermined amount of change in the command signal to the carburetor which is maintained for a time interval equal to the transport time of the mixture from the carburetor through the engine to the oxygen sensor. With the engine running under a fairly steady state condition the amount of correction and the duration thereof are sufficient to cause the sensor to switch back to its original state, and in this way the air/fuel ratio is closely regulated about the desired operating point. Where the engine experiences a more dynamic change in its operation, additional correction is made after the termination of the transport time interval. Extreme transient conditions cause interruption of the closed-loop mode of operation in favor of the open-loop mode; the open-loop mode also prevails during initial running of the engine after starting. When the system mode changes from closed-loop to open-loop, the integrator signal is locked in the integrator so that when the closed-loop operation resumes, the system can more rapidly attain the desired operating point. The closed-loop circuitry also contains a programming device which provides programming capability without requiring change to the layout of the circuit on a circuit board. There is also a fault detection circuit which provides for fault detection, such as might be occasioned by a failed oxygen sensor. Additional features are also disclosed.

7 Claims, 30 Drawing Figures

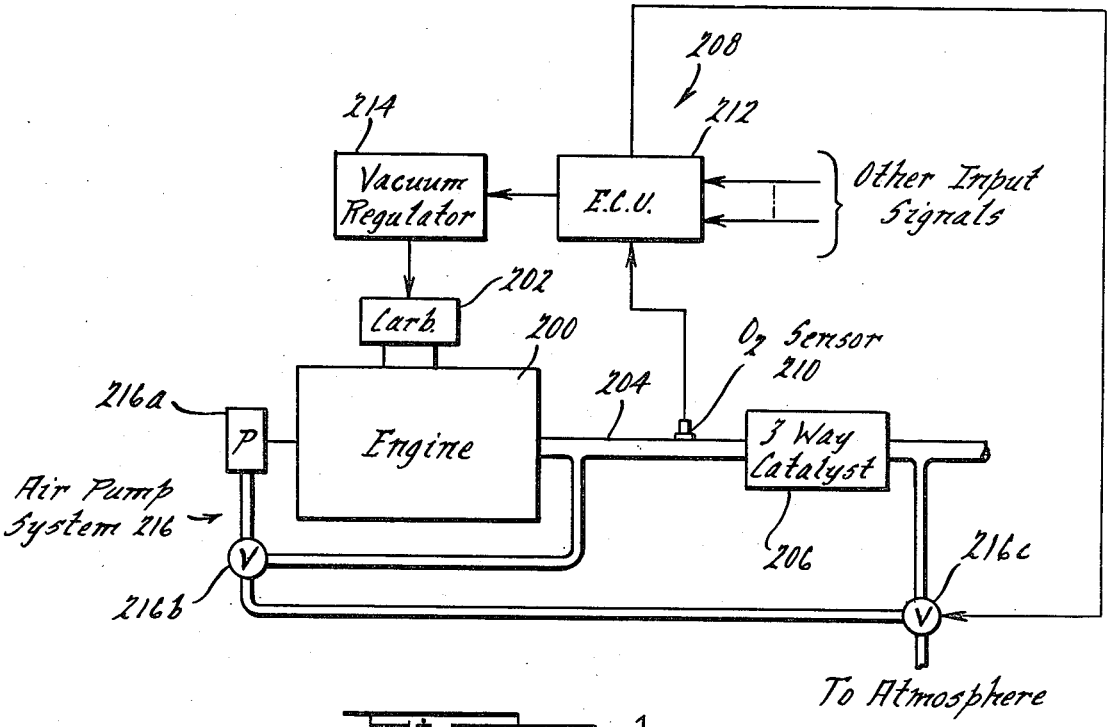
FIG. 1.
FIG. 19.
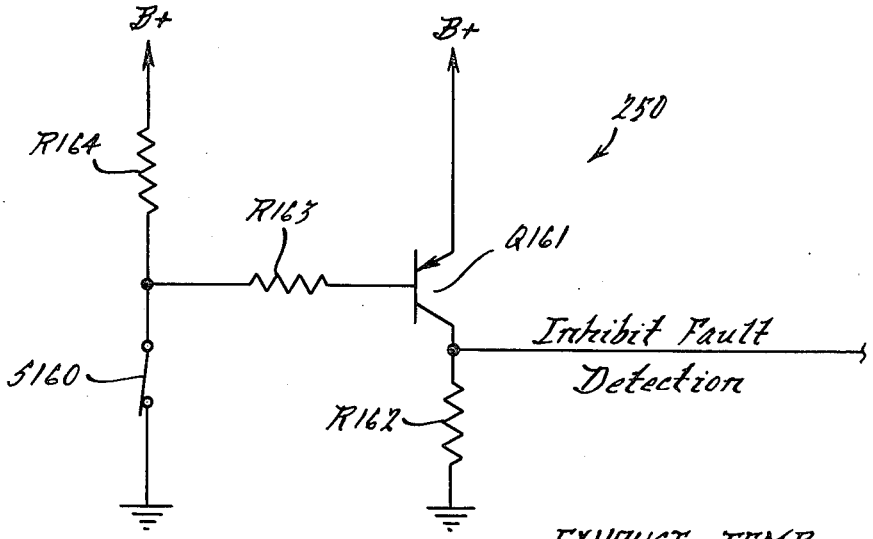
EXHAUST TEMP. CIRCUIT 250

OXYGEN SENSOR CIRCUIT 218

STABILITY CIRCUIT 222

INTEGRATOR CIRCUIT 220

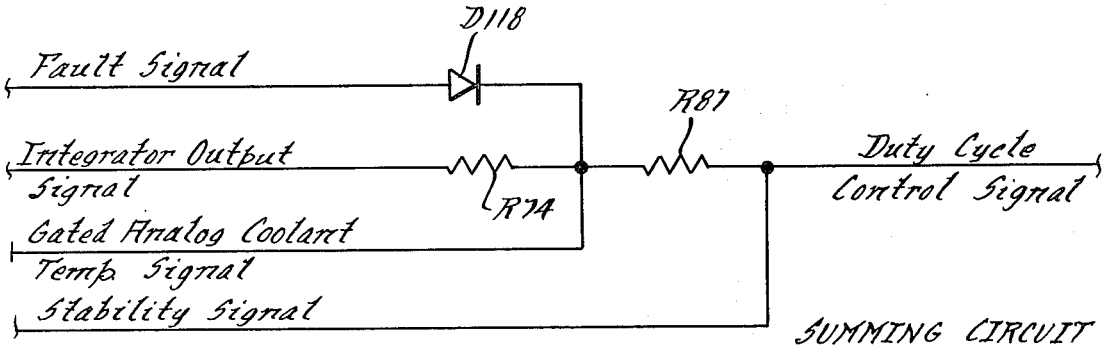
SUMMING CIRCUIT 225
FIG. 6.
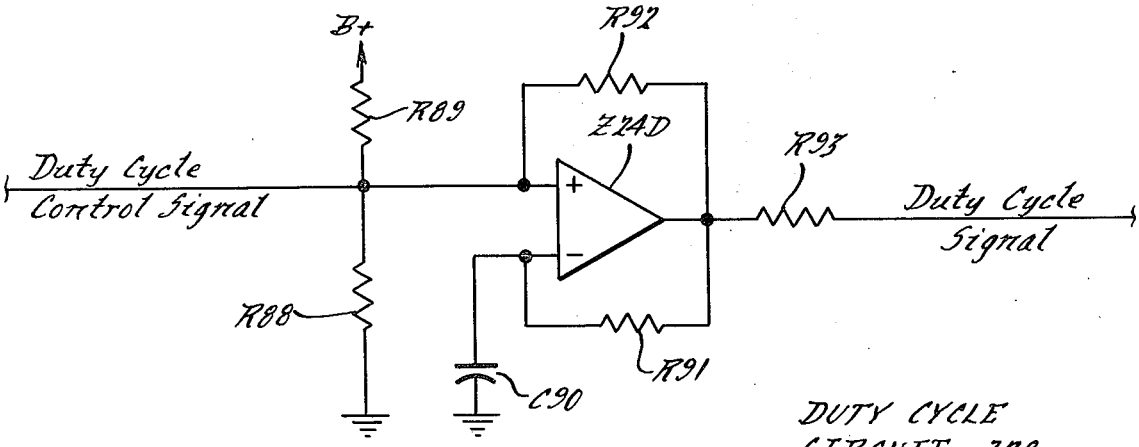
DUTY CYCLE CIRCUIT 228
FIG. 7.
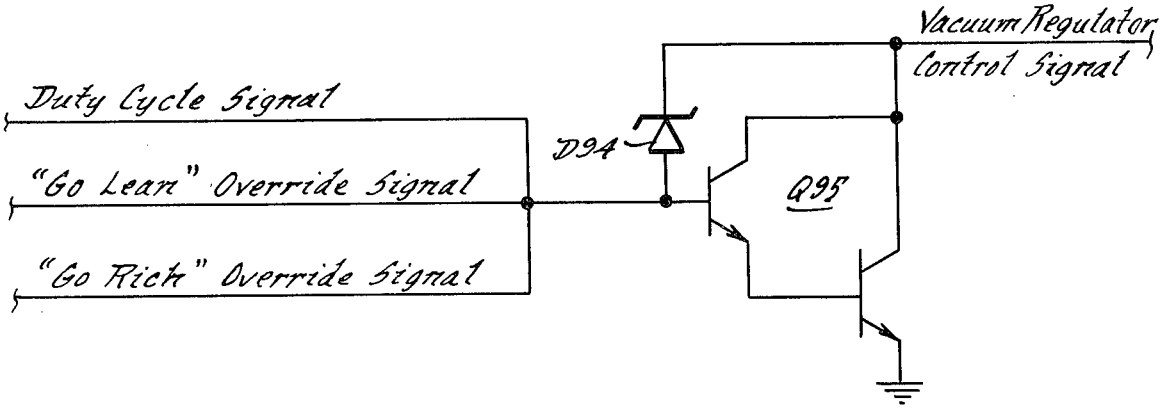
FIG. 8. VACUUM REGULATOR DRIVER CIRCUIT 230

INTEGRATOR RATE CONTROL AND PROGRAMMING CIRCUIT 224

ENGINE LOAD SENSING CIRCUIT 236

LEAN ON DECEL CIRCUIT 238

FAULT DETECTION CIRCUIT 226

LEAN ON CRUISE CIRCUIT 240

AIR/FUEL RATIO CONTROL FOR AN INTERNAL COMBUSTION ENGINE USING AN EXHAUST GAS SENSOR

BACKGROUND AND SUMMARY OF THE INVENTION

The present invention pertains to an air/fuel ratio control for an internal combustion engine using an exhaust gas sensor, and in the preferred embodiment disclosed herein is concerned with an electronic feedback carburetor system including an oxygen sensor.

Although the basic concepts relating to air/fuel ratio control systems for automotive internal combustion engines using exhaust gas sensors have been long known, in recent years there have been a number of patents issued relating to improvements in such systems. Generally, the improvements are a result of the application of electronic technology to the problem of reducing exhaust emissions output of the engine while improving the engine fuel economy and obtaining satisfactory driveability of the vehicle. Some of these improvements are relatively crude and unsophisticated. Others are more elaborate and complicated.

In addressing the problem of designing an electronic feedback carburetor system applicants have made new discoveries and have developed a new and unique system which achieves new and unique modes of operation resulting in significant improvements in a number of different respects over other systems of which applicants are aware. As a result, an electronic feedback carburetor system embodying principles of the invention attains heretofore unachieved results and exhibits advantages which are not provided by other systems. Moreover, the invention, in its preferred embodiment, makes use of the latest electronic technology to provide a system wherein the electronics can be conveniently and economically packaged for mass production usage, yet is capable of being readily programmed to meet specific engine requirements. While details of the invention will be explained later in the description of the preferred embodiment, the more impressive improvements which are believed new and unique in applicants' system may be generally set forth as follows.

One feature of the present invention relates to the development of a control signal which provides for more precise regulation of the air/fuel ratio when the system is operating in the closed-loop mode. One problem in obtaining precision control arises from the limitations of commercially available oxygen sensors which are suitable for use in an automotive vehicle. These sensors present an impediment because they only possess a switching characteristic at stoichiometry and can therefore indicate only a rich mixture or a lean mixture condition. Applicants have overcome this impediment through the provision of an integrator circuit and a stability circuit which both receive a rectangular waveform signal derived from the oxygen sensor. The two circuits in turn develop respective output signals which cooperate to produce a composite signal which controls the air/fuel ratio. The integrator by itself develops a ramp type signal which ramps in one direction when the oxygen sensor is in one state and in the opposite direction when the oxygen sensor is in the other state. The stability circuit is responsive to transitions of the oxygen sensor from one state to the other and develops a signal which may be generally described as being the derivative of the oxygen sensor signal. This composite signal referred to above is developed by algebraically summing the integrator and stability circuit signals. In response to a change in state in the oxygen sensor, this composite signal commands a predetermined amount of correction of the air/fuel ratio which is maintained at essentially a constant level for a time interval essentially equal to the transport time of the mixture from the carburetor through the engine to the oxygen sensor. With the engine operating at a reasonably steady state condition, the amount of correction is such that by the conclusion of the transport time interval, the oxygen sensor will have switched back to its original state. In this way, the air/fuel ratio is closely regulated to be within a narrow window about the desired operating point which may be at or in the vicinity of stoichiometry. This enables a more precise and accurate control of the air/fuel ratio to be obtained which is advantageous in securing the best performance of certain types of catalysts which subsequently treat the exhaust gases after they have passed by the oxygen sensor. While the disclosed embodiment utilizes analog circuits, it will be appreciated that the principles of this aspect of the invention may be applied to other embodiments using digital circuits or microprocessors. Where the engine is operating under a more dynamic condition and the amount of correction is insufficient to change the state of the oxygen sensor, additional correction is performed.

Another feature of the invention is that there are additional circuits which are responsive to more extreme transient conditions, such as substantial changes in engine load, engine deceleration, etc., and are operative to interrupt the closed-loop mode of operation in favor of an open-loop mode of operation.

A further feature of the invention is that when the closed-loop mode of operation is interrupted, the output signal of the integrator circuit is locked (or held in memory) so that when the closed-loop mode of operation resumes, the integrator output signal is at a level which will enable the system to quickly return to the window about the desired operating point.

Still another feature of the invention relates to the provision of a programming device in the circuit whereby the closed-loop operating point may be programmed without having to make changes in the layout of the circuit board containing the circuit electronics. According to this aspect of the invention a programming circuit section which is associated with the integrator contains a socket which is hard-wired onto the circuit board. Another element, called a header, is inserted into the socket to perform the programming function. The header contains circuit paths which connect certain of the terminal pins on the socket with certain other terminal pins in such a way that a selected characteristic is programmed into the circuit depending upon the particular header which is used. This is of significant advantage in the application of the invention to the mass production of automotive engines since it means that changes in the calibration of the system can be made expeditiously and without requiring substantial tooling changes. Thus, rather than having to change components on the circuit board and the circuit board layout, all that is necessary is to make a new header which can be done expediently and without any substantial amount of tooling change. Circuitry on the board coacts with the programming device to shift the operating point under certain conditions of engine operation, and this constitutes a further feature of the invention.

The system also includes circuits responsive to initial operating conditions of the engine whereby the closed-loop mode of operation is prevented until both the engine is warmed up and a certain "after start" timing interval has elapsed after the engine has started. During this initial open-loop mode of operation, an analog coolant temperature signal related to engine temperature is utilized to control the air/fuel mixture to the exclusion of the composite signal from the integrator and stability circuits.

Another aspect of the invention provides for detection of certain system faults or failures. For example, the disclosed embodiment has a fault detection circuit which is particularly useful in connection with detection of a failed oxygen sensor. When such a failure is detected, a fault signal is given to both provide an alarm via an alarm circuit and is also utilized to control the air/fuel ratio to the exclusion of the other signals which usually control the air/fuel ratio.

Additional features are also disclosed and may be seen with reference to the ensuing disclosure and accompanying drawings. Naturally, the recitation of the inventive features set forth above is merely to acquaint the reader with the disclosure and should not be construed as limiting the scope of the invention or its various aspects because it is the set of claims at the conclusion of this specification which define the invention in its various aspects.

The invention is disclosed in connection with a preferred embodiment thereof according to the best mode presently contemplated in carrying out the invention.

BRIEF DESCRIPTION OF THE DRAWINGS

FIG. 1 is a diagrammatic illustration of the general organization of an example of a closed-loop engine control system embodying principles of the present invention.

FIGS. 3 through 19 are individual electronic schematic circuit diagrams, each illustrating circuit details of a corresponding one of the blocks of the system shown in FIG. 2.

DESCRIPTION OF THE PREFERRED EMBODIMENT

Description of FIG. 1

Figure 2:
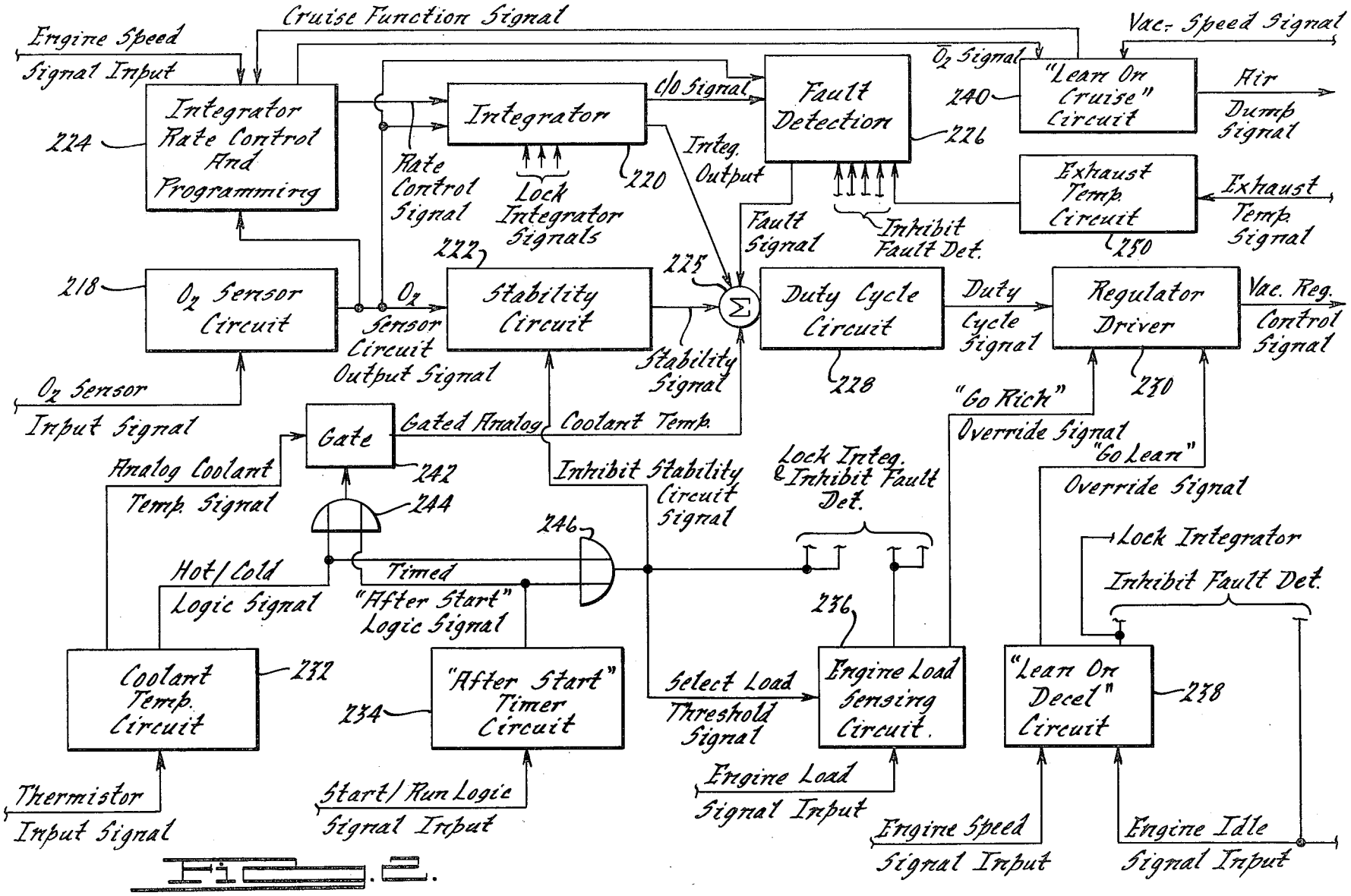
FIG. 2 is a schematic diagram in block diagram form illustrating further detail of a portion of the system shown in FIG. 1.

By way of introduction, FIG. 1 illustrates the general organization of an example of a closed-loop control system embodying principles of the present invention. Briefly, the Figure schematically portrays an internal combustion engine 200 including a carburetor 202 which supplies a combustible air/fuel charge for combustion in the cylinders of the engine. Engine power is developed by ignition of the charge. The products of combustion are exhausted via a conventional exhaust system 204. Exhaust system 204 conducts the combustion products to a 3-way catalyst 206 whose purpose is to oxidize and reduce the usual noxious products of combustion, namely, hydrocarbons, carbon monoxide, and oxides of nitrogen, before discharge to atmosphere. In order to most efficiently utilize the capabilities of catalyst 206, a closed-loop control system 208 is provided to control the air/fuel ratio of the charge mixture supplied by carburetor 202 to engine 200 as a function of the oxygen concentration present in the combustion products passing through exhaust system 204 prior to entering catalyst 206. An oxygen sensor ($O_2$ sensor) 210 mounts at a suitable location on exhaust system 204 to communicate with the exhaust products passing therethrough and sense the oxygen concentration present therein. Oxygen sensor 210 is electrically connected with an ECU (electronic control unit) 212 to supply thereto an input signal representative of the oxygen concentration. Other input signals (to be hereinafter explained in greater detail) are also supplied as inputs to ECU 212. In turn ECU 212 develops a command control signal which is supplied to an electropneumatic vacuum regulator 214. This command signal represents the desired air/fuel ratio of the charge which carburetor 202 should be supplying to the engine. The vacuum regulator in turn supplies a control vacuum signal to carburetor 202 which causes the carburetor to adjust the air/fuel ratio of the charge to the commanded value. An air pump system 216 including an engine driven air pump **216*a* may be employed to pump air into the exhaust system. The disclosed system contains a temperature controlled diverter valve 216*b* which is selectively operable to cause the pumped air to be introduced either upstream or downstream of catalyst 206. Generally, pressurized air is fed upstream of the catalyst before the engine has fully warmed up and downstream with the engine warmed-up. For this purpose, valve 216*b* may be made responsive to engine coolant temperature so that when the sensed coolant temperature is less than a selected temperature, for example 98° F., air is fed upstream and when the sensed coolant temperature is above the selected temperature, the air is fed downstream. As will be seen later, the closed-loop mode of operation does not occur until the coolant temperature is somewhat above that at which valve 216*b* diverts so that when the closed-loop mode of operation does occur the oxygen sensor is exposed essentially only to the products of combustion which emanate from the engine cylinders. An electrically actuated dump valve 216*c* is located in the downstream path from diverter valve 216*b* and is selectively operable to divert downstream air to atmosphere when a dump signal is given by ECU 212**. The conditions under which the dump signal is given will be explained later in the description.

Briefly, the system of FIG. 1 operates in the following manner during the closed-loop mode of operation. Oxygen sensor 210 supplies to ECU 212 a signal which indicates one of either two conditions: (1) either a certain oxygen concentration in the combustion products (indicative of a leaner than stoichiometric ratio being supplied to the engine by the carburetor); or (2) a lack of oxygen therein (indicative of a richer than stoichiometric ratio). The ECU command signal supplied to the vacuum regulator causes the air/fuel ratio supplied by carburetor 202 to progressively richen when a leaner than stoichiometric condition is indicated by the oxygen sensor; correspondingly, it causes the ratio to progressively lean when a richer than stoichiometric condition is indicated. In this way, the air/fuel ratio is caused to vary about the stoichiometric ratio (air/fuel ratio equal 14.7) between a slightly richer than stoichiometric ratio and a slightly leaner than stoichiometric ratio. As will be seen from the later description, features of the present invention provide variations in the command signal during closed-loop operation such that new and improved modes of operation are achieved. As will also be more fully explained in the ensuing description, other features of the invention relate to the newly found desirability of interrupting the closed-loop mode of operation under certain conditions and instead having the system operate in an open-loop mode. These likewise create new and improved modes of operation.

Description of FIG. 2

Features of the present invention are disclosed in greater detail in FIG. 2 which is a block diagram illustrating the arrangement and construction of ECU 212 in its presently preferred embodiment. Before proceeding with the description of FIG. 2, it should be appreciated by the reader that the FIG. 2 illustration is intended to facilitate his comprehension of the principles of the present invention and that no inference of limitation of the invention's scope should be drawn by virtue of the specific designations given to the blocks or to the specific selection of and inter-relationship between the blocks shown, because the scope of the invention is defined by the appended claims at the conclusion of this specification.

It is deemed desirable to first follow the closed-loop path between the $O_2$ sensor input signal and the command output to the vacuum regulator, called the vacuum regulator control signal. ECU 212 comprises an oxygen sensor circuit 218 to an input of which the oxygen sensor 210 is connected to supply the oxygen concentration signal also referred to as the $O_2$ sensor input signal. The oxygen sensor circuit in turn produces a corresponding output signal (called the $O_2$ sensor circuit output signal) which is supplied to an integrator circuit 220, to a stability circuit 222, to an integrator rate control and programming circuit 224, and to a fault detection circuit 226. The four circuits 218, 220, 222 and 224 form a portion of the closed-loop path. Integrator circuit 220 and stability circuit 222 develop respective output signals which are supplied as inputs to a summing circuit 225. Summing circuit 225 develops a resultant signal which is representative of the desired air/fuel ratio which is to be commanded by the ECU. This resultant signal from the summing circuit is supplied to a duty cycle circuit 228 which develops a duty cycle signal that is supplied to a regulator driver circuit 230. The regulator driver circuit 230 produces the vacuum regulator control signal, which is the command signal supplied to the vacuum regulator for causing adjustment of the carburetor so that the charge inducted by the engine possesses the desired air/fuel ratio.

ECU 212 comprises additional circuits including a coolant temperature circuit 232, an "after start" timer circuit 234, an engine load sensing circuit 236, a "lean on decel" circuit 238, and a "lean on cruise" circuit 240. These five circuits 232, 234, 236, 238 and 240 receive external input signals. Coolant temp circuit 232 is connected to a thermistor which senses temperature of the engine. One way of sensing engine temperature is to dispose the thermistor in a coolant passage of the engine to sense the engine coolant temperature, as exemplified by the present embodiment. After start timer circuit 234 receives what is called a "start/run" signal input which, as will be explained in greater detail hereinafter, is a logic signal which indicates when the engine is being started (i.e., being cranked). Engine load sensing circuit 236 receives a signal representative of engine load, for example, intake manifold vacuum or throttle angle-speed relationship. Lean on decel circuit 238 receives both an engine speed signal which is representative of engine speed and an engine idle signal which indicates that the throttle is in the idle (i.e., maximum throttling) position. Lean on cruise circuit 240 receives which is referred to as a vacuum-speed signal which will be explained in greater detail hereinafter but briefly is indicative of the vehicle being driven in a cruise condition.

Two further input signals are an engine speed signal input supplied to integrator rate control and programming circuit 224 and the engine idle signal to fault detection circuit 226.

There is additional internal circuitry within ECU 212 which interconnects the various circuits already described. Coolant temp circuit 232 develops at one output thereof an analog coolant temperature signal representative of engine temperature. This analog coolant temp signal is supplied to one input of a gate circuit 242. The output of gate circuit 242 connects to an input of summing circuit 225. Gate circuit 242 is controlled by a signal from a logic gate 244, which may be conveniently considered as an OR logic gate. One input of OR gate 244 receives a hot/cold logic signal which is developed by coolant temp circuit 232 at another output thereof. Gate 244 also receives what is called the timed after start logic signal from after start timer circuit 234. In this way the analog coolant temp signal is selectively gated to summing circuit 225 under certain engine temperature and start/run conditions hereinafter described. The hot/cold logic signal and the timed after start logic signal are also supplied to respective inputs of a second logic gate 246 which may also be conveniently considered as an OR logic gate. The signal from OR logic gate 246 serves four purposes. The first purpose is to supply an inhibit stability circuit signal to stability circuit 222. The second is to supply a select load threshold signal to engine load sensing signal 236. The third is to supply a lock integrator signal to integrator circuit 220. And the fourth is to supply an inhibit fault detection signal to fault detection circuit 226. This multi-purpose signal from gate 246 is given under certain engine temperature and start/run conditions hereinafter explained. Engine load sensing circuit 236 supplies lock integrator and inhibit fault detection signals to integrator circuit 220 and fault detection circuit 226 respectively. Circuit 236 also supplies a "go rich" override signal to regulator driver 230. Lean on decal circuit 238 supplies lock integrator and inhibit fault detection signals to integrator circuit 220 and fault detection circuit 226 respectively and in addition supplies a "go lean" override signal to regulator driver 230. Lean on cruise circuit 240 supplies a cruise function signal to integrator rate control and programming circuit 224 and also receives a logic signal from circuit 224. The lean on cruise circuit also provides the output signal which is used to actuate dump valve 216*c*.

An exhaust temperature circuit 250 senses exhaust temperature and provides a logic signal indicative of whether the exhaust temperature is above or below a temperature which serves to distinguish between a hot and a cold oxygen sensor, for example, 650° F. As will be seen in the later description, this exhaust temperature signal is used in conjunction with detection of a failed oxygen sensor.

Before proceeding with the description of circuit details of the individual blocks shown in FIG. 2, it is beneficial to briefly explain in a general way the operation of the system with reference to FIG. 2. First, the closed-loop mode of operation will be briefly explained and secondly the various conditions under which closed-loop operation is interrupted and replaced by open-loop modes of operation will be set forth.

The oxygen sensor circuit output signal may be considered as a generally rectangular waveform. When this waveform is at one signal level (for example, when the signal level is high, as in the present embodiment), a richer than stoichiometric ratio is indicated. Correspondingly, a low level indicates a leaner than stoichiometric ratio. Integrator circuit 220 and stability circuit 222 coact upon the oxygen sensor circuit output signal to provide respective output signals which are algebraically summed by circuit 225 and supplied to duty cycle circuit 228. This input signal to circuit 228 represents the desired air/fuel ratio. The integrator output signal may be considered as a ramp type signal which ramps in one direction when the oxygen sensor output signal is at its high level and in the opposite direction when the oxygen sensor circuit output signal is at its low level. The slope of the integrator output signal is a function of the rate control signal supplied to integrator circuit 220 from integrator rate control and programming circuit 224. Briefly, the rate control signal is principally a function of engine speed and a certain number, or numbers, programmed by circuit 224. However, under certain conditions, the cruise function signal supplied from lean on cruise circuit 240 will modify the rate control signal. The stability signal from circuit 222 may be generally considered as being related to the derivative of the oxygen sensor circuit output signal. However, this statement is merely a generalization and the specific function of the stability circuit will be particularly explained hereinafter. The duty cycle circuit develops from the summation of the intergrator output and stability signals, the duty cycle control signal, which may be considered generally as a rectangular waveform. This duty cycle signal may exhibit by way of example a nominal 50% duty cycle. This 50% duty cycle will cause the vacuum regulator and carburetor to respond with a stoichiometric mixture. The duty cycle is however varied as a function of the input signal to the duty cycle circuit, and the duty cycle generally fluctuates about stoichiometric. The regulator driver circuit serves to amplify the duty cycle signal in such a way that the vacuum regulator and carburetor respond to produce the commanded air/fuel ratio of the combustion chamber. Therefore, it may now be understood that in the normal closed-loop mode of operation the air/fuel ratio of the charge is caused to fluctuate about stoichiometric.

The four circuits 232, 234, 236 and 238 shown along the bottom of FIG. 2 generally serve to cause the system to operate in an open-loop mode under certain conditions. The coolant temp circuit 232 provides the analog coolant temperature signal indicative of the engine temperature and also provides the hot/cold logic signal which indicates when the engine is cold and when the engine is warmed up. The after start timer circuit 234 provides the timed after start logic signal which is indicative of a certain time having elapsed after the engine has been started. The amount of time is selected to provide for warm-up of oxygen sensor 210. It may be desirable to modulate the length of the time interval by engine speed. For example, a timer circuit may have its timing rate made proportional to engine speed so that the length of the interval decreases as the average engine speed increases. As a consequence, this will cause closed-loop operation in an already warmed up engine to occur sooner after re-starting where the engine is run at higher speed immediately after such restarting.

Briefly, the two circuits 232, 234 cooperate with the two OR logic gate circuits 244, 246 to create an open-loop mode of operation under either of the two following conditions: (1) when the engine is cold, or (2) during the timed after start interval. Closed-loop operation is prevented by locking the integrator with the lock integrator signal which is supplied from OR gate 246 to integrator 220. With the integrator locked, an alternate means is needed to set the duty cycle signal. In this instance it is done by gating the analog coolant temperature signal through gate 242 to summing circuit 226 whereby the duty cycle signal is modulated as a function of engine temperature to cause the carburetor to supply an air/fuel ratio which is correlated with engine temperature. During this open-loop mode the stability signal is also inhibited by the inhibit stability circuit signal from gate 246.

The engine load sensing circuit 236 monitors the engine load. If the system is in the closed-loop mode and the load on the engine exceeds a certain threshold, circuit 236 operates to open the loop and concurrently cause the carburetor to deliver an enriched air/fuel mixture to power the increased engine load. The threshold is established by the select load threshold signal supplied from the output of gate 246. The select load threshold signal is a logic signal which causes the engine load to be compared against one of the two thresholds, either a lower threshold or a higher threshold, by circuit 236. Because the signal at the output of gate 246 is developed from the hot/cold logic signal and the after start timer signal, the threshold which is selected becomes a function of these two signals. Load sensing circuit 236 is sensitive to the lower threshold when either the engine is cold or the after start timer circuit has not timed out. Correspondingly, it is sensitive to the higher threshold only after both the engine has warmed up and the after start timing interval has also elapsed. One should now recognize that load sensing circuit 236, by itself, will not cause the open-loop mode of operation to occur while the lower threshold is being selected. This is because the selection of the lower threshold is predicated upon either circuit 232 or 234 already causing an open-loop mode of operation. Because circuit 236 is configured to supply the go-rich override signal any time that the load exceeds the selected threshold, the go-rich override signal will be given when the load exceeds the lower threshold which presumes that neither the engine has warmed up nor the after start timer has timed out. After both the engine has warmed up and also the after start timing interval has elapsed, the go-rich override signal will be given whenever the load exceeds the higher threshold; and assuming that the system is operating in the closed-loop mode at this time, circuit 236 will lock integrator circuit 220 thus causing an open-loop mode of operation to ensue so long as the higher threshold continues to be exceeded.

The lean on decel circuit 238 operates to interrupt the closed-loop mode of operation when the throttle is operated to maximum throttle position and the engine speed concurrently exceeds a predetermined value. The lean on decel circuit interrupts the closed-loop mode of operation by locking integrator circuit 220, and it also supplies the go lean override signal to regulator driver circuit 230. This causes the carburetor to supply as lean an air/fuel ratio as possible.

Lean on cruise circuit 240 adjusts the integrator rate control and programming circuit when a cruise condition is indicated. During cruise condition, closed-loop operation is maintained. However, the rate control signal from integrator rate control and programming circuit 224 is modified to cause the average air/fuel ratio supplied by the carburetor to be somewhat leaner than stoichiometric.

Briefly, the fault detection circuit is operable only in the closed-loop mode of operation with the exhaust being hot enough to have warmed up the sensor. During the closed-loop mode of operation the fault detection circuit looks for possible deterioration or failure of the oxygen sensor and related circuitry. If a fault condition is detected the fault signal is supplied to summing circuit 225 causing the air/fuel ratio to assume a particularly desired value. It should be pointed out that if there is a failure in the oxygen sensor or related circuitry essentially the fault signal alone will control the air/fuel ratio. If a fault is detected, an alarm will be actuated to inform the driver that a malfunction has occurred and should be corrected.

Detailed Description of Individual Circuits

Figure 3:
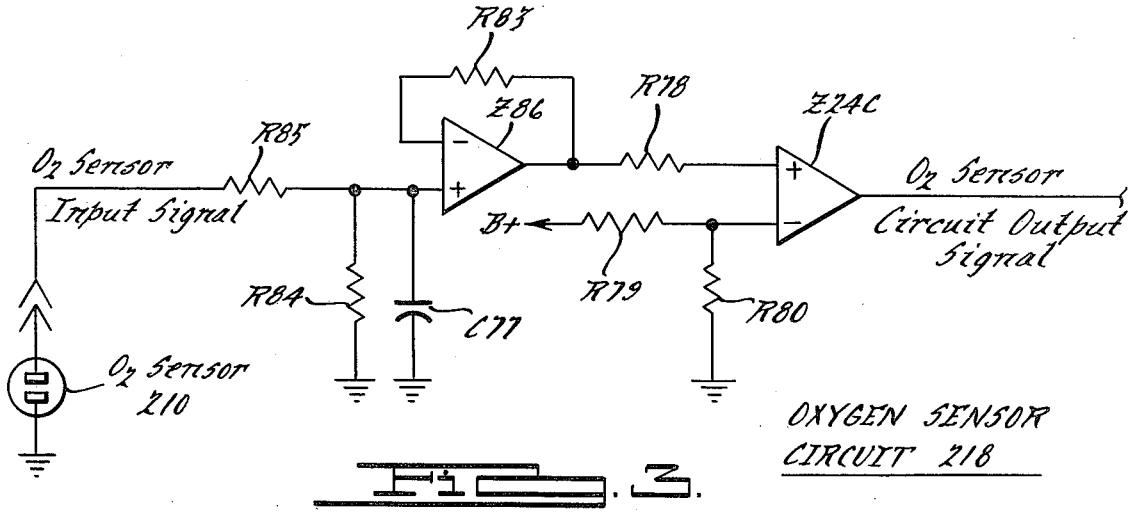

Circuit details of the construction of the blocks shown in FIG. 2 are set forth in FIGS. 3–19. The circuits operate from a suitable power supply (not shown) which supplies a regulated B+ potential relative to ground. While most of the connections of the circuits to the power supply are shown, there are a number of operational amplifiers and comparators in the circuits which are connected with the power supply in conventional manner but whose connections are not shown in the drawings in the interest of clarity. The ensuing description will deal first with the circuit details of those blocks constituting the closed feedback loop. Attention is therefore directed first to FIG. 3 which shows circuit details of oxygen sensor circuit 218.

As shown, oxygen sensor 210 is connected in an input circuit including a pair of resistors R84, R85 and a capacitor C77 to the non-inverting input terminal of an operational amplifier Z86 which has feedback resistor R83 connecting its output terminal to its inverting input terminal. The output of the operational amplifier is in turn coupled through a resistor R78 to the non-inverting input of a second operational amplifier Z24C. This second operational amplifier, however, is connected in this instance to function as a comparator circuit. Therefore, a reference voltage is supplied to the inverting input terminal of operation amplifier Z24C by means of a voltage divider comprising resistors R79 and R80 which are serially connected across the B+ supply and whose junction is connected to the inverting input terminal of the operational amplifier. The output signal supplied by operational amplifier Z24C represents the oxygen sensor circuit output signal which is supplied to the other circuits illustrated in FIG. 2.

Oxygen sensor 210 represents a commercially available device which generates a small electrical potential when exposed to exhaust gases containing a lack of oxygen (i.e., a rich mixture condition). Correspondingly, when the sensor is exposed to a certain concentration of oxygen in the exhaust gases (i.e., a lean mixture condition) the sensor outputs essentially no voltage. The sensor exhibits a rather pronounced switching characteristic as the oxygen concentration of the sensed gases passes through a point corresponding to stoichiometry; thus, the sensor may be considered as supplying a rectangular waveform signal as the air/fuel mixture supplied to the engine fluctuates about stoichiometric.

Circuit 218 operates in the following manner. The first stage of circuit 218 acts to shape and buffer the sensor output signal supplied by the oxygen sensor to make it suitable for use with the second stage of circuit 218. The second stage operates as a threshold detector so that the oxygen sensor circuit output signal supplied by circuit 218 may be considered as a more refined version of the oxygen sensor signal which is input to circuit 218. It should be pointed out, however, that when there is a failure in the oxygen sensor, the oxygen sensor circuit output signal will no longer assume a rectangular shape but instead will simply be a constant level signal. As will be explained in greater detail hereinafter, particularly in connection with the description of fault detection circuit 226, the illustrated oxygen sensor circuit provides a way for detecting certain types of sensor failure.

Figure 5:
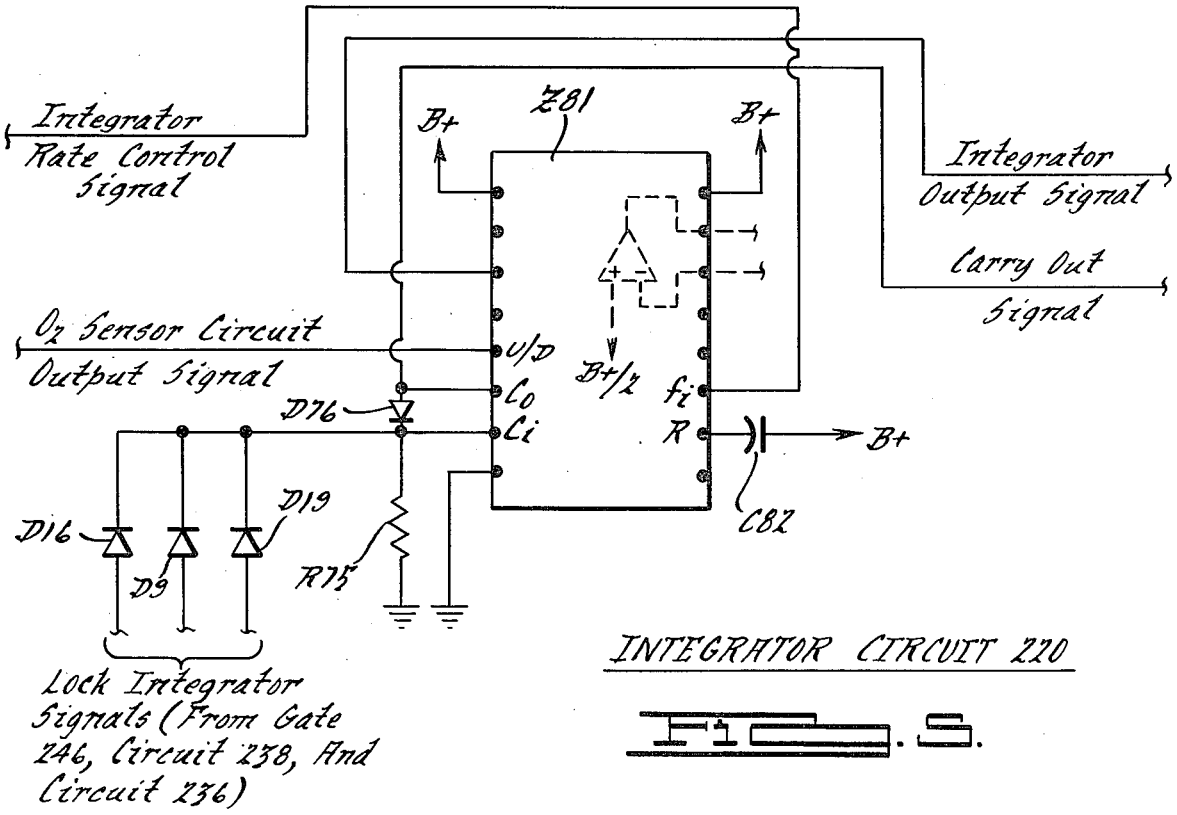

Details of integrator circuit 220 are shown in FIG. 5. The illustrated integrated circuit comprises a custom integrated circuit Z81 which is disclosed in U.S. patent application Ser. No. 772,604 filed Feb. 28, 1977 now U.S. Pat. No. 4,109,164 and assigned to the same assignee as the present application. The disclosure of the prior application insofar as it pertains to the integrated circuit Z81 is hereby incorporated in the present application by reference. The circuit Z81 comprises a plurality of sixteen terminal pins, available for connection according to the illustrated scheme. As viewed in FIG. 5, the terminal pins, proceeding from top to bottom on the left hand side and then from bottom to top on the right-hand side, correspond to the terminal pins (1) through (16) respectively of the custom integrated circuit device in said prior application. The oxygen sensor circuit output signal is supplied to the up/down control terminal U/D of the integrated circuit Z81 to control the direction in which the integrator integrates. Integration is performed in integrated circuit Z81 by a multi-bit binary counter. The counter is enabled to count in one direction when the oxygen sensor circuit output signal is at one level, and in the opposite direction when the signal is at the other level. The rate of integration is determined by the integrator rate control signal which is applied to the input terminal $f_i$ of circuit Z81. The integrator rate control signal is received from integrator rate control and programming circuit 224 and is in the form of pulses which are at a frequency related to the engine speed. Thus, the counter counts the pulses of the integrator rate control signal and either adds the pulses to or subtracts the pulses from the count in the integrator in accordance with the up/down direction control provided by the oxygen sensor circuit output signal. Integrated circuit Z81 also contains a stage which converts the multi-bit binary signal of the counter into an analog singal, and it is this analog signal which is supplied from circuit Z81 as the integrator output signal to summing circuit 225. Thus, the integrator output signal may be considered generally as a triangular shaped waveform; however, the slope and the durations of the segments constituting the waveform are functions of engine speed, a certain number or numbers programmed by circuit 224, and the cruise function signal when it is given.

Integrated circuit Z81 further supplies a carry out signal which is given whenever the count in the counter reaches either its maximum or its minimum (i.e., all "zeroes" or all "ones"). The carry out terminal is designated $C_o$. As will be seen in greater detail hereinafter, the carry out signal is used in conjunction with the fault detection circuit 226. As shown in FIG. 5 there are additional circuit components, namely, diodes D9, D16, D19, and D76 and resistor R75, which are connected in a circuit associated with the clock inhibit terminal $C_i$ of circuit Z81. These are utilized in connection with interruption of the closed-loop mode of operation and will be considered in detail hereinafter in connection with the description of the open-loop modes of application. The capacitor C82 couples the reset terminal R of circuit Z81 to the positive supply so that when the supply is turned on, a reset pulse is coupled to reset the count of the integrator.

The integrator output signal from integrator circuit 220 is supplied to one input of summing circuit 225 as can be seen in FIG. 6. Three other signals are also supplied as inputs to summing circuit 225; however, in the closed-loop mode of operation only the integrator output signal and the stability signal are components of the duty cycle control signal because the other two signals (the fault signal and the gated analog coolant temp signal) are permitted to control only in certain open-loop modes of operation. Appropriate scaling of the input signals to the summing circuit is accomplished by the resistors R74, R87 in conjunction with the additional circuitry to be described later. The duty cycle control signal is supplied from summing circuit 225 to the duty cycle circuit 228.

Figure 4:
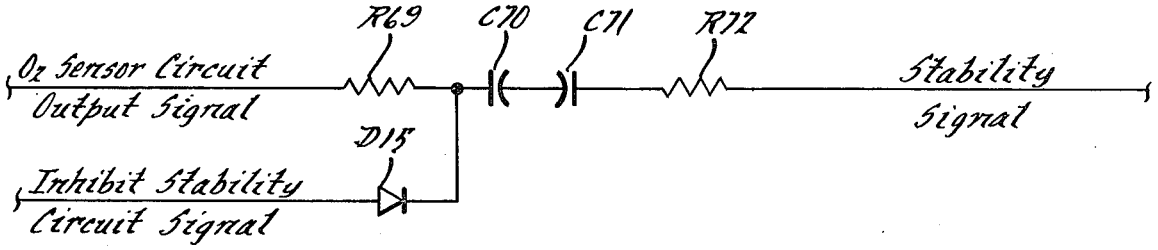

Details of stability circuit 222 are shown in FIG. 4. Circuit 222 comprises a diode D15, two resistors R69 and R72, and two capacitors C70 and C71. The two resistors R69, R72 and the two capacitors C70 and C71 form a series circuit coupling the oxygen sensor circuit output signal from circuit 218 to one input of summing circuit 225. The two capacitors C70, C71 are equivalent to a single capacitance. Disregarding for the moment the effect of diode D15, the two resistors R69 and R72 form an equivalent resistance whereby the circuit is equivalent to a simple RC series circuit which couples the oxygen sensor circuit output signal to summing circuit 225. The RC equivalent circuit serves to approximately differentiate the oxygen sensor circuit output signal, and thus the stability signal may be considered as approximately the derivative of the oxygen sensor circuit output signal. Because the oxygen sensor circuit output signal is in the nature of a rectangular waveform signal, the stability signal therefore takes the form of a series of pulses wherein each pulse comprises a sharp jump immediately followed by a decaying exponential transient. Each pulse occurs in response to an edge of the rectangular oxygen sensor circuit output signal waveform. A positive polarity pulse is developed in response to each positive-going edge of the oxygen sensor circuit output signal waveform, and a negative polarity pulse in response to each negative-going edge.

The purpose of utilizing the stability signal in conjunction with the integrator output signal is to develop the duty cycle control signal as a composite signal equal to the algebraic sum of the two input signals whereby, in response to a change in state of the oxygen sensor, the air/fuel ratio supplied to the engine is changed in an amount calculated to counteract the change in state of the oxygen sensor and is held at approximately this level for a certain time period which will allow for the transport time required for flow from the carburetor through the engine to the oxygen sensor. With the engine running in a fairly steady state condition and with the system in a closed-loop mode, this composite signal will normally be sufficient to cause the oxygen sensor to switch back to its original state after the transport time nas elapsed. In this way, the air/fuel mixture of the combustible charge is closely controlled about a desired level. If the engine is in a more dynamic state of operation where either the amount of change, or the allowed transport time, or both, is insufficient to cause the oxygen sensor to switch back to its previous state, then the composite signal begins to make a further additional correction calculated to cause the oxygen sensor to return to its previous state. A more detailed description of this operation and the cooperative effect of the stability and integrator signals will be given later in the specification with reference to additional illustrative explanatory waveforms.

When the stability signal is to be inhibited, the inhibit stability circuit signal assumes a logic one (i.e., a positive potential) coupled through diode D15 to the junction of resistor R69 and capacitor C70. Because the potential at this junction is held high by the inhibit stability circuit signal, the effects of change in the oxygen sensor circuit output signal are not transmitted through to summing circuit 225, and hence the stability signal makes no contribution to the duty cycle control signal developed by summing circuit 225.

In FIG. 7, the duty cycle circuit is seen to comprise an operational amplifier Z24D, a plurality of resistors R88, R89, R91, R93, and a capacitor C90 connected with operational amplifier Z24D as illustrated. The duty cycle circuit is configured to provide the duty cycle signal as what may be considered as a nominal rectangular waveform signal having a nominal frequency and a nominal duty cycle. The nominal duty cycle in the example corresponds to 50% and the nominal frequency may be on the order of 10 hertz. The purpose of the duty cycle control signal is to vary the duty cycle of this nominal signal; however, when the duty cycle is varied, there occurs a slight correlative variation in the frequency from its nominal value. It is the variation in duty cycle, not frequency, which controls the air/fuel ratio. The duty cycle signal is in turn supplied to the vacuum regulator driver circuit 230.

In FIG. 8, the vacuum regulator driver circuit is shown to comprise a Darlington transistor Q95 with a zener diode D94 connected as illustrated between the base and collector of the Darlington transistor. Two additional input signals (i.e., "go lean" override and "go rich" override) are supplied to the base of transistor Q95 along with the duty cycle signal. During closed-loop operation, only the duty cycle signal controls the conductivity of the Darlington transistor. The two other signals can occur only during open-loop modes of operation hereinafter explained. The driver circuit serves to drive vacuum regulator 214 with a duty cycle signal corresponding to that of the duty cycle signal provided by the duty cycle circuit 228. The vacuum regulator operates to adjust the metering mechanism of carburetor 202 so as to increasingly lean the mixture when the oxygen sensor senses a rich condition of the mixture and to richen the mixture when the oxygen sensor senses a lean condition. Although the frequency of the duty cycle signal varies to a certain extent with variation in the duty cycle, the frequency remains within the response range of the regulator so that frequency variations do not influence the response of the regulator. The vacuum regulator imposes an inductive load on the collector of transistor Q95. Diode D94 advantageously improves the response of the regulator to the on-and-off switching of the transistor by making it more closely follow the transistor switching action. This completes the brief description of the circuits forming the closed feedback loop.

Attention is now directed to details of the four circuits 232, 234, 236 and 238 which can interrupt the closed-loop mode of operation under certain conditions.

Figure 10:
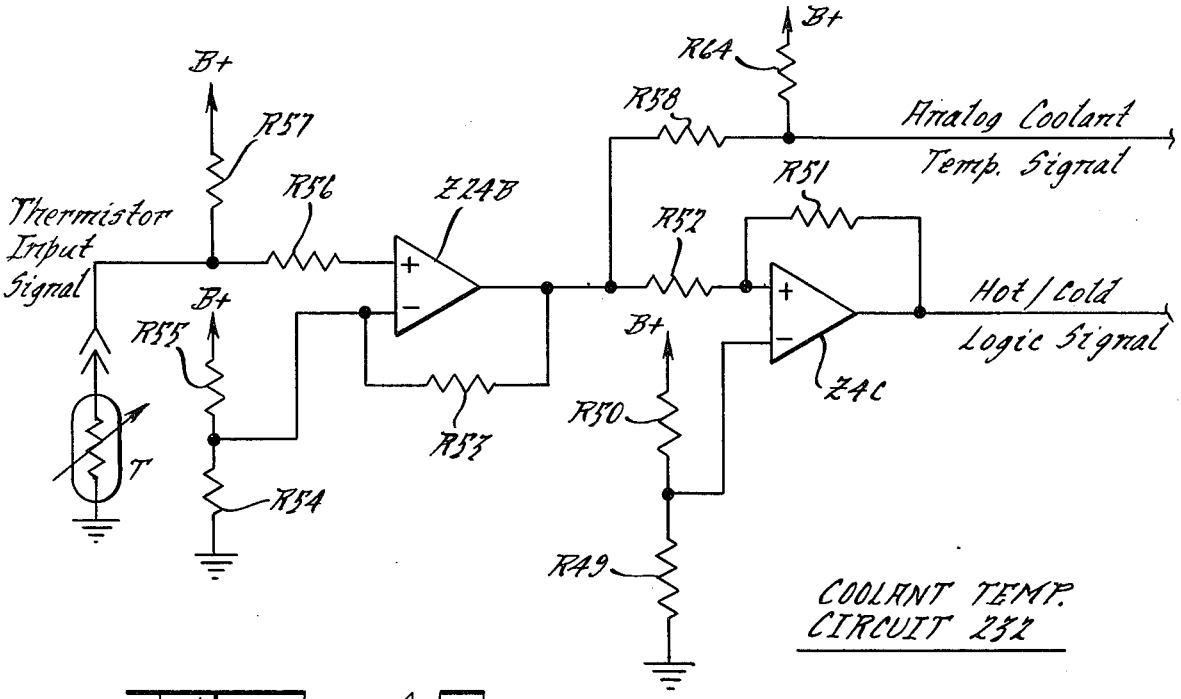

Details of the coolant temp circuit 232 are shown in FIG. 10. The input to the circuit is provided by a thermistor T which is suitably mounted on the engine to sense engine temperature, for example, by measuring the temperature of engine coolant. The coolant temp circuit comprises an amplifier stage associated with the thermistor to develop the analog coolant temp signal. This stage includes an operational amplifier Z24B and a plurality of associated resistors R53, R54, R55, R56, R57,R58 and R64 connected in circuit as illustrated. The circuit configuration is such that as the temperature sensed by thermistor T changes, the analog coolant temp signal correspondingly changes. A signal correlated to the analog coolant temp signal is supplied through a resistor R52 to the non-inverting input of a comparator Z4C. A reference is supplied by a voltage divider comprised of resistors R50, R49 to the inverting input of the comparator Z4C and is selected to provide a temperature which is used to damarcate between a hot engine and a cold engine. So long as the analog coolant temp signal is indicative of an engine temperature below the reference, the engine is considered to be cold and therefore the output signal provided by comparator Z4C remains low (i.e., a logic "zero"). If the engine temperature now increases to above the reference, the output of comparator Z4C switches to provide a high logic level output (i.e., a logic "one") which is representative of a hot, or warmed-up engine. By way of example, the reference point may be selected at 150° F. so that the engine would be considered cold at coolant temperatures below 150° F. A resistor R51 is connected between the output and the non-inverting input of comparator Z4C to impart a certain hysteresis to the switching characteristic of the comparator to avoid toggling at the vicinity of the reference.

Figure 11:
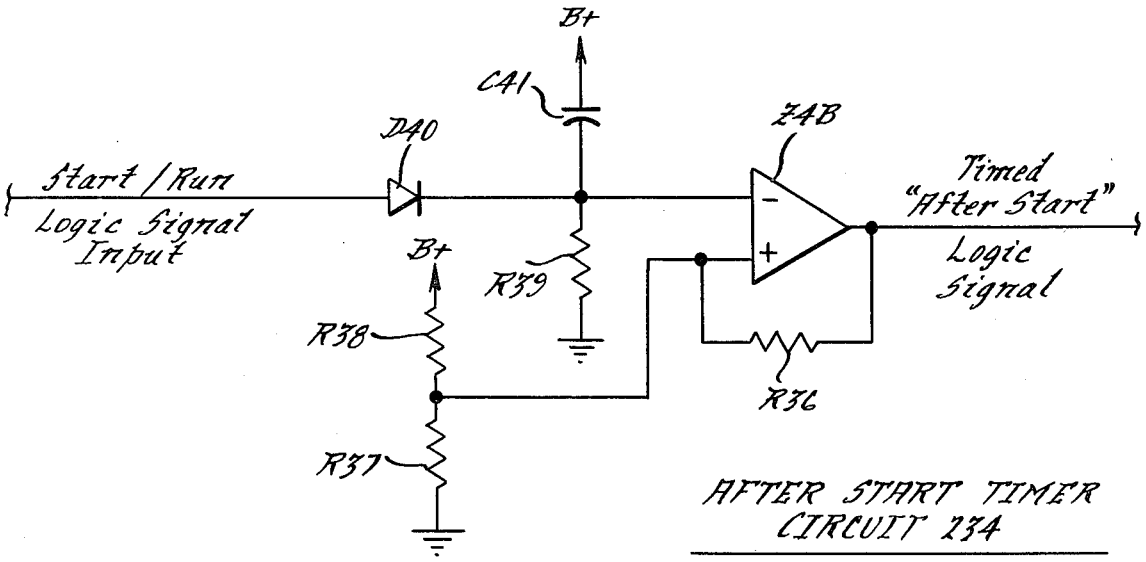

The after start timer circuit 234 is shown in FIG. 11. The circuit comprises a comparator Z4B, a plurality of resistors R36, R37, R38, R39, a diode D40 and a capacitor C41, connected as illustrated in the drawing. The voltage divider formed by resistors R37, R38 supplies a reference potential to the non-inverting input of comparator Z4B. The start/run logic signal input is supplied through diode D40 to the inverting input of the comparator. The start/run logic signal is a level signal indicative of either engine starting or engine running condition. The signal may be developed from the ignition switch such that when the start contact of the ignition switch is energized, a high level logic signal (i.e., a logic "one") is coupled through diode D40 to the inverting input of comparator Z4B. Under this condition capacitor C41 is essentially uncharged, and the output of comparator Z4B, which represents the timed after start logic signal, provides a low logic signal (i.e., logic "zero"). When the engine has started and begins to run under its own power, the typical operation is to release the ignition switch so that the start contact is deenergized. When this happens the logic "one" at the cathode of diode D40 is removed. Capacitor C41 now be begins to charge through resistor R39. As the capacitor charges, the voltage at the inverting input of comparator Z4B decays from essentially the B+ potential level toward ground. When the transient passes through the level of the reference established by resistors R38, R37 at the non-inverting input of the comparator, the comparator output switches to provide a high logic signal for the timed after start logic signal. As will be appreciated, the time at which the logic signal switches from low to high is determined by the time constant of resistor R39 and capacitor C41 in relation to the reference level provided by resistors R37 and R38. In the illustrated embodiment the parameters are so selected that the after start timer logic signal switches from a low to a high approximately 25 seconds after the start contact is denergized.

Figure 12:
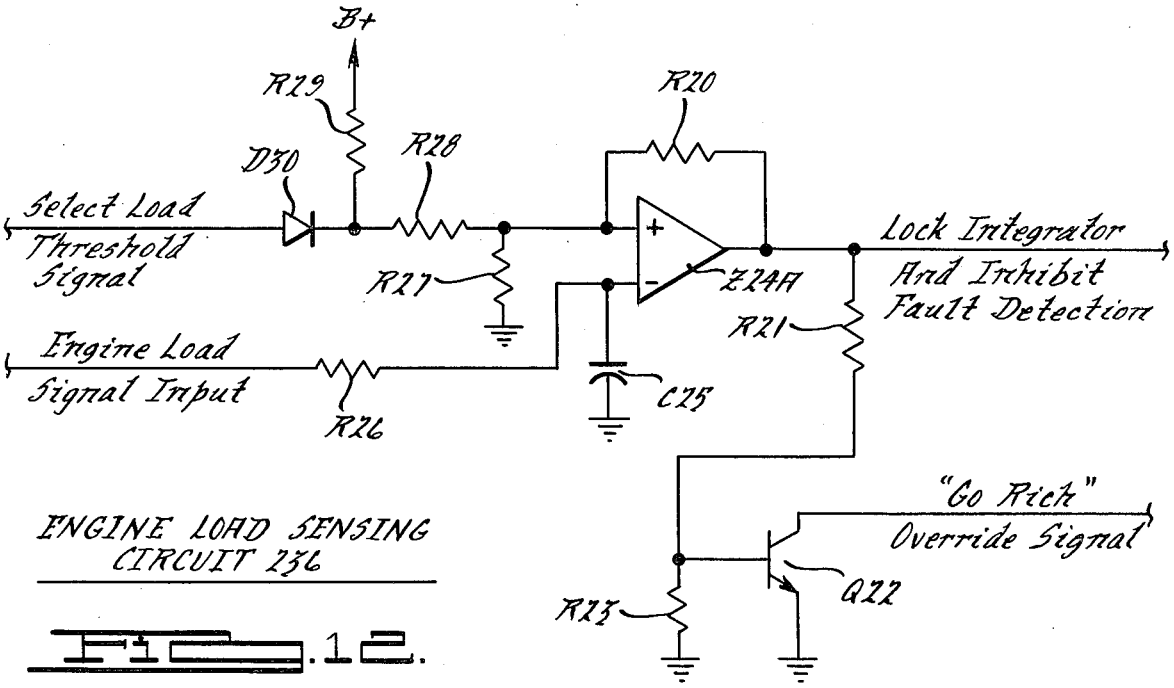

FIG. 12 discloses details of the engine load sensing circuit 236. The circuit comprises an operational amplifier Z24A with a resistor R20 connected between the output and the non-inverting input of the operational amplifier. One input circuit comprising a resistor R26 and a capacitor C25 couples the engine load signal input to the inverting input of operational amplifier Z24A. Another input circuit comprising resistors R27, R28, R29 and a diode D30 is connected with the non-inverting input of the operational amplifier and the select load threshold signal is supplied via this circuit. The engine load signal input may be developed in any suitable manner and in the present embodiment is developed by means of a vacuum transducer and associated circuitry which monitors intake manifold vacuum. The specific engine load signal is a pulse type signal wherein the pulse width represents the intensity of manifold vacuum. By way of example, the transducer and associated circuitry may be of the type shown in U.S. Pat. No. 3,997,801 assigned to the same assignee as the present application. Although the specific manner in which the select load threshold signal is developed will be explained in greater detail hereinafter, it may be briefly described as a logic type signal which supplies via the diode D30 either essentially a B+ potential signal (logic "one") or essentially a ground signal (logic "zero") to the cathode of diode D30. When the select load threshold signal is at logic zero, the voltage divider comprised of resistors R29, R28, and R27 supplies a reference to the non-inverting input of comparator Z24A which is indicative of a given level of engine load, for example, three inches of mercury, intake manfold vacuum. When the select load threshold signal is at a logic one condition, the reference to the non-inverting input of the comparator is changed and is established primarily by the characteristics of diode D30 and resistors R27 and R28. This may correspond to an intake manifold vacuum of six inches of mercury. So long as the engine load signal input remains below the selected reference level, the output signal appearing at the output of operational amplifier Z24A remains at a logic zero. However, when the load signal exceeds the threshold, the output signal switches to a logic one condition. The occurrence of the logic one condition provides the lock integrator and inhibit fault detection signals which respectively lock integrator 220 and inhibit fault detection circuit 226. A circuit comprising resistors R21, R23 and a transistor Q22 serves to monitor whether the engine load signal is exceeding the threshold by monitoring the signal at the output of operational amplifier Z24A. When the signal at the output of the operational amplifier is at a logic one level, transistor Q22 is conductive to cause the "go rich" override signal to be given to driver circuit 230. The "go rich" override signal causes the carburetor to supply as rich a mixture as possible for powering the increased load on the engine. Correspondingly, when the output of operational amplifier Z24A is at a logic zero level, transistor Q22 is non-conductive and has no effect on the carburetor. In order words at engine loads below the threshold, the "go rich" override cannot be given.

Figure 13:
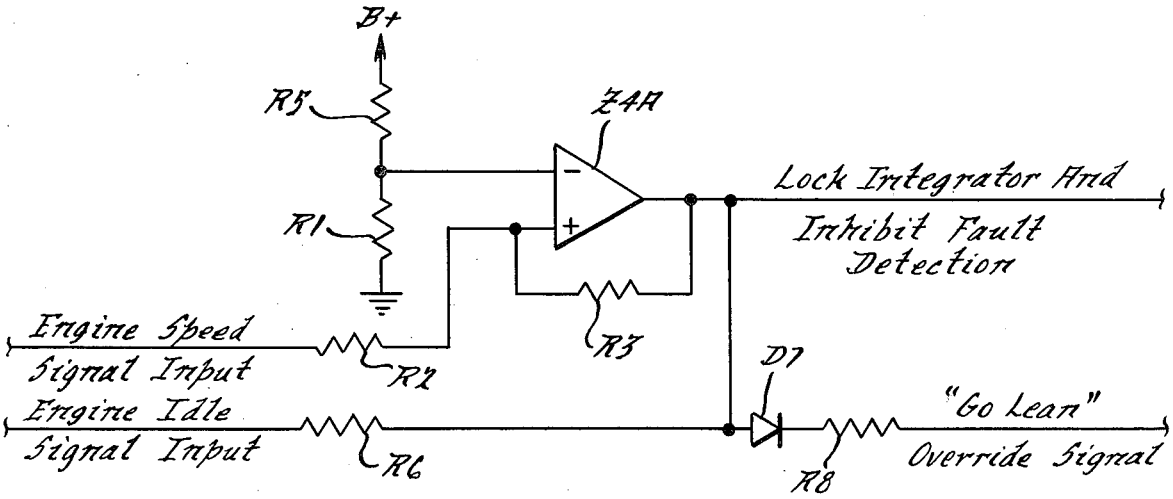
Figure 14:
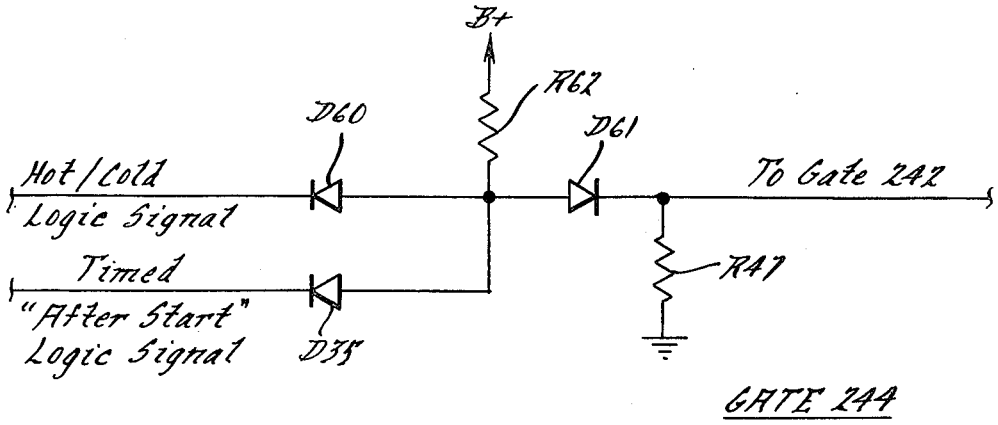

In FIG. 13, details of lean on decel circuit 238 are shown. The circuit comprises a comparator Z4A to whose inverting input a reference potential is supplied by the voltage divider comprised of resistors R1 and R5. An engine speed signal input is supplied through a resistor R2 to the non-inverting input of the comparator, and a resistor R3 connects the comparator output to the non-inverting input to provide a certain hysteresis in the switching characteristic. The remaining components of the circuit include resistors R6, R8 and a diode D7 which are connected as shown. The output of comparator Z4A is connected to the junction of resistor R6 and diode D7. The engine idle signal input is supplied through resistor R6, and the go lean override signal is provided via the diode D7 and the resistor R8. The engine speed signal input is an analog signal whose magnitude increases with increasing engine speed. The engine idle signal input may be considered as a logic signal which provides a logic one input when the throttle is in idle. The circuit operates such that the signal at the output of comparator Z4A is at a logic one level only when the engine speed is above the reference speed level and the engine throttle is in the idle position, in other words, during an engine deceleration from a higher running speed with the operator having fully released the throttle. Under all other conditions the output is at a logic zero level. When the signal is at the logic one level, it serves to lock the integrator circuit and to inhibit the fault detection circuit. Also, when at the logic one level, the signal causes the "go lean" override signal to be given to driver circuit 230. This "go lean" override signal causes the carburetor to generate as lean an air/fuel mixture as possible.

The hot/cold logic signal and the timed after start logic signal are utilized by the two OR gates 244 and 246. Considering first FIG. 14 which illustrates gate 244, it can be seen that the hot/cold logic signal and the timed after start logic signal are supplied via corresponding diodes D60 and D35 to the junction of a divider circuit comprising resistors R62, R47 and a diode D61 connected as illustrated. The logic function performed by gate 244 is such that a condition of either engine cold or after start timer not timed out is detected. Thus, the output signal at the junction of diode D61 and resistor R47 will be a logic zero (i.e. low) when either the engine is cold or so long as the after start timer has not timed out. The signal supplied by gate 244 is for the sole purpose of controlling transmission of the analog coolant temperature signal through gate 242.

Figure 15:
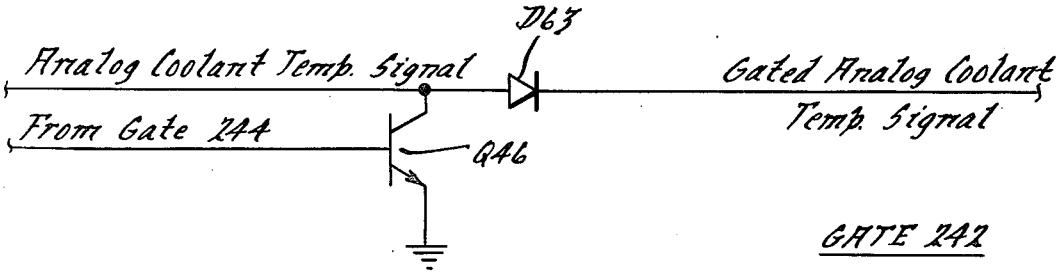

This latter gate is disclosed in FIG. 15. Gate 242 comprises a diode D63 and a transistor Q46 connected as illustrated. So long as transistor Q46 is non-conductive the analog coolant temperature signal is transmitted directly through diode D63 to summing circuit 225. However, when transistor Q46 is conductive the signal is shorted out through the collector-emitter circuit of the transistor and does not pass to summing circuit 225. The conductivity of transistor Q46 is controlled by the logic signal received from gate 244. When this signal is at a logic one level the transistor is conductive and when at a zero logic level the transistor is not conductive. Thus, when the engine is cold or the after start timer has not timed out, there is a low logic signal level supplied to the base of transistor Q46 thereby enabling the analog coolant temperature signal to be gated to summing circuit 225. Similarly, only when both the engine has warmed up and the after start timer has timed out does transistor Q46 conduct to cause the transmission of the analog coolant temperature signal through the gate to summing circuit 225 to be terminated.

Figure 16:
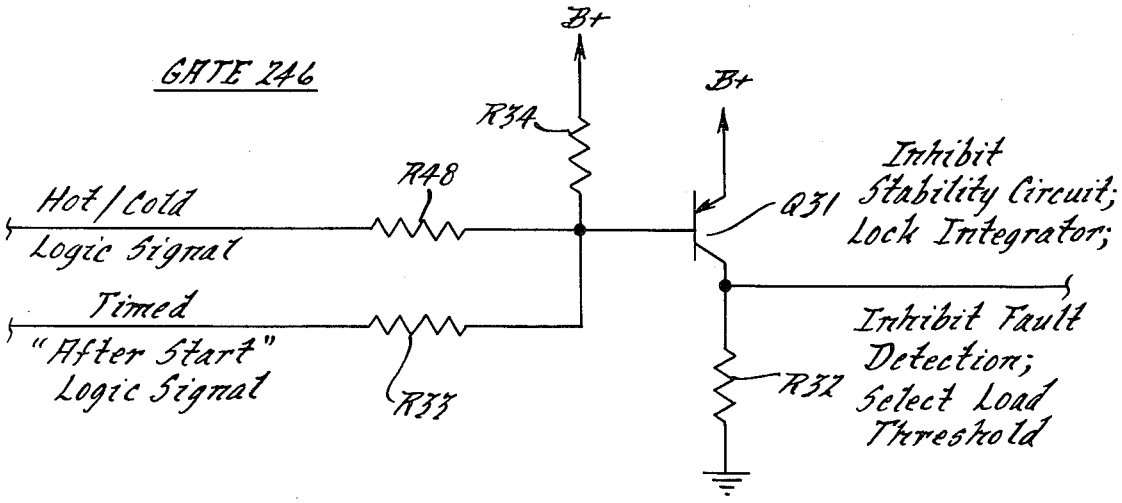

The gate 246 is shown in FIG. 16 to comprise four resistors R32, R33, R34, R48 and transistor Q31 connected as illustrated. The circuit operates such that when either the hot/cold logic signal or the timed after start logic signal is at a logic zero, transistor Q31 is conductive to cause the signal at its collector to be at a logic one level. Stated another way, only when the engine is hot and the after start timer has timed out does the output signal at the collector of transistor Q31 assume a logic zero. The output signal performs the four functions indicated.

The cooperation between gate 246 and circuits 220, 222 and 226 and 236 can now be better understood. The signal developed at the output of circuit 246 has been indicated in FIG. 16 to be the logic function engine cold or after start timer not timed out. As explained above, this signal serves four distinct purposes. One purpose is to set the load threshold of engine load sensing circuit 236. Thus, when either the engine is cold or the after start timer has not timed out, a lower load threshold is set than when the engine is hot and the after start timer has timed out. Thus, it will be recognized that the go rich override signal is given to regulator driver circuit 230 at a lower engine load when the engine is cold or when the after start timer has not timed out than would be the case if the engine were warm and the after start timer has timed out. The second purpose of the signal from gate 246 is to inhibit the stability circuit signal. The stability circuit requires a high logic signal level to be inhibited. Thus, when either the engine is cold or the after start timer has not timed out the stability circuit is inhibited. This is because it is desired to use the stability signal only in the closed-loop mode which, as will be explained later, is allowed to occur only after engine warmup and the after start has timed out.

The remaining two purposes of the output signal of gate 246 are to lock integrator circuit 220 and to inhibit fault detection circuit 226. Locking of the integrator and inhibiting of the fault detection circuit require high logic signal levels in the illustrated embodiment. Thus, the integrator will be locked and the fault detection will be inhibited either if the engine is cold or the after start timer has not timed out. Stated differently, it becomes possible for the integrator circuit to integrate and the fault detection circuit to detect faults only after the engine has warmed up and the after start timer has timed out.

Fault detection circuit 226 in cooperation with oxygen sensor circuit 218 and the exhaust temperature sensing circuit 250 provide a capability for detecting certain types of sensor failure. Two types of sensor failure which can be detected are (1) where the sensor loses its ability to generate a sufficient voltage signal when exposed to exhaust gases indicative of a rich mixture condition and (2) where the output impedance of the sensor becomes excessively high so that a suitable potential signal cannot be delivered to the oxygen sensor circuit. Both modes of failure are characterized by a negligible voltage signal output of the oxygen sensor. However, a properly operating sensor provides essentially a negligible voltage output when it is exposed to exhaust gases indicative of a lean mixture condition. Furthermore, before the sensor has warmed up, it inherently exhibits a high output impedance. Therefore, to distinguish between a sensor which is truly failed and a properly operating sensor it becomes necessary to introduce additional discriminating factors. One factor is engine exhaust temperature, and a suitable signal is supplied by the exhaust temperature circuit 250 of FIG. 19.

The exhaust temperature circuit includes a sensing switch S160 which is disposed to sense exhaust temperature. When the exhaust temperature is below a certain level where the sensor would not be considered as having warmed up (say 650° F.), the switch is closed, and when the exhaust temperature rises above this level, the switch opens. The switch is connected in the input of a transistor circuit including a transistor Q161 and resistors R162, R163, and R164 connected as shown. The circuit operates such that when the sensed exhaust temperature is below 650° F., a logic one signal is given at the collector of transistor Q161, and when the temperature is above 650° F. a logic zero is given. The logic one signal causes the circuit to supply a fault inhibit signal to inhibit fault detection circuit 226 whereby a fault cannot be detected until the exhaust temperature has risen above a temperature where the sensor is considered to have been warmed up, i.e., 650° F.

After the exhaust temperature has risen above the threshold level to where it is possible to detect a failed sensor, it now is desired to look at the integrator output signal to determine if the sensor has failed. Because a failed sensor provides essentially the same output signal as a properly operating sensor which is exposed to a lean mixture, the feedback circuit will be commanding a rich mixture in response to a failed sensor. Therefore, one way of dectecting this is to look at the content of the integrator circuit counter. By connecting the carry out terminal $C_o$ with the clock inhibit terminal $C_i$ via the diode D76, the counter counts in a non-overflow mode. When a lean mixture condition, is indicated by the oxygen sensor circuit output signal, the integrator counter is caused to count down because the oxygen sensor circuit output signal supplied to the up/down terminal U/D is a logic zero. Thus, a failed sensor will cause the counter to count down as far as it can. When this point is reached a logic one signal is produced at the carry out terminal $C_o$ to lock up the counter via diode D76 by supplying a logic one to the clock inhibit terminal $C_i$. The carry out signal is also coupled to the fault detection circuit.

Figure 17:
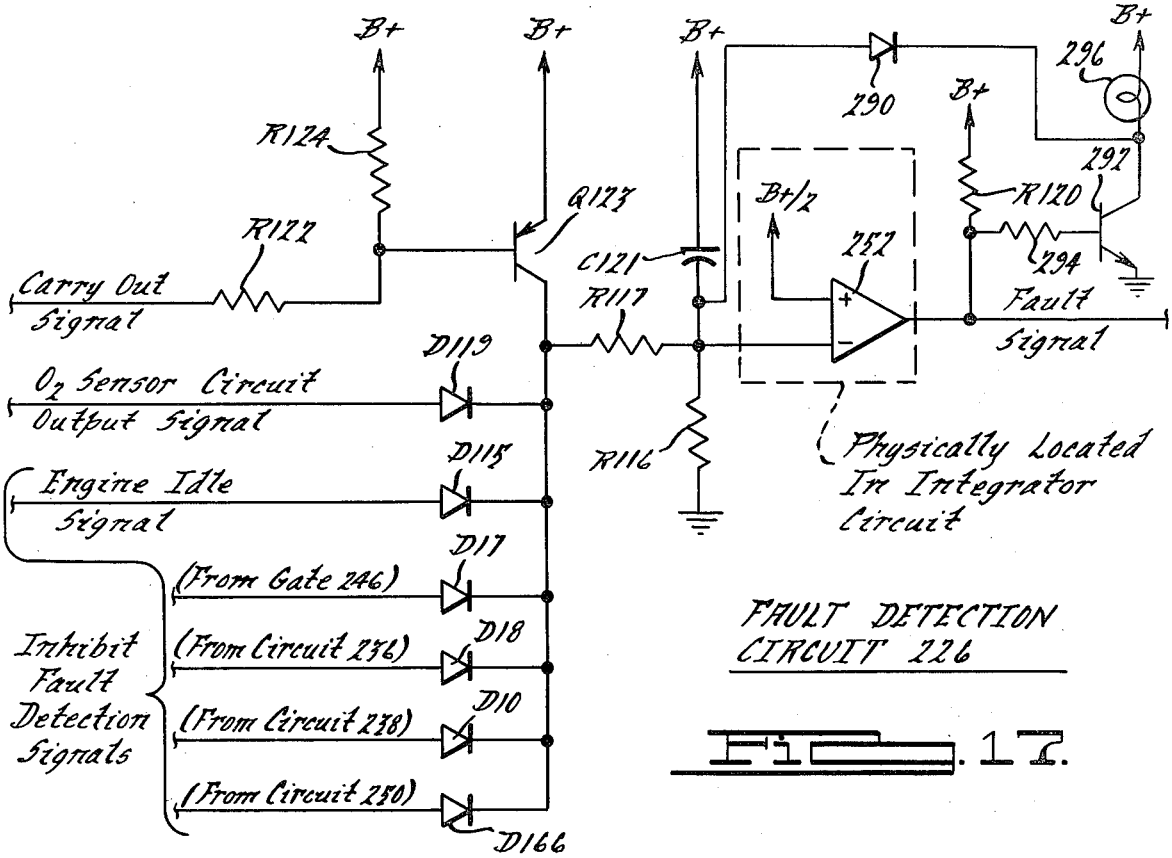

With the foregoing description in mind, attention can now be directed to details of fault detection circuit 226 shown in FIG. 17. Circuit 226 comprises an input transistor circuit including a transistor Q123. A pair of resistors R124 and R122 are connected in the base circuit of transistor Q123 with the carry out signal from integrator circuit 220 being supplied thereto in the manner shown. A further pair of resistors R117 and R116 are connected as a collector load for transistor Q123. The fault detection inhibit signals from the respective circuits 246, 236, 238, 250, are supplied via respective diodes D17, D18, D10 and D166 to the junction of the collector of transistor Q123 and resistor R117. The engine idle signal is also in the nature of a fault detection inhibit signal and is supplied to said junction through the diode D115. The oxygen sensor circuit output signal is also supplied via diode D119. Basically, the input signals supplied from the other circuits via the respective diodes to the junction of transistor Q123 and resistor R117 are utilized in the performance of an OR logic function and thus the diodes D119, D115, D117, D18, D10, and D166 are in the nature of a six input OR gate. If any one of the input signals to this OR gate is high (i.e., logic one), the signal at the collector of transistor Q123 is forced high. Stated differently, the signal at the collector of transistor Q123 can go low (i.e., logic zero) only when all input signals to the OR gate are at logic zero signal levels.

There is further circuitry in fault detection circuit 226 comprising a capacitor C121, a comparator 252 and a resistor R120 connected as illustrated. As shown, the comparator 252 is physically located internally of the integrated circuit Z81 of integrator circuit 220. However, it is functionally in the fault detection circuit and not in the integrator circuit. The junction of capacitor C121, resistor R117 and resistor R116 is coupled directly to the inverting input, and the non-inverting input is referenced to one-half of the B+ potential. The relative proportions of the two resistors R117 and R116 are such that the latter has a much larger resistance than the former. Thus, so long as any one of the input signals to the six input OR gate is high, a high potential is coupled through to the inverting input of comparator 252 to cause the signal at the output of the comparator to assume a zero logic level. This zero logic level corresponds to the absence of a fault.

Assuming now that all inputs to the six input OR gate are low, it is the carry out signal which determines whether the fault signal is given. As explained earlier, the carry out signal is normally at a logic zero level when the sensor and circuitry are operating in the closed loop mode. With the carry out signal at a logic zero level, transistor Q123 is conductive to cause a high potential to be supplied to the inverting input of comparator 252, and thus as expected, no fault signal is given in this instance. Now if it is assumed that a fault has occurred, the carry out signal will assume a logic one level for reasons explained earlier. This causes transistor Q123 to become non-conductive. Now, the circuit connected to the inverting input of comparator 252 begins to execute a timing transient with capacitor C121 charging through resistor R116. This creates a diminishing positive potential at the inverting input of comparator 252 and when the transient has decayed to a point where the level at the inverting input drops below the potential at the non-inverting input, the comparator switches to cause a logic one to appear at the output thereof. The occurrence of this logic one signal is indicative of a fault condition and represents the fault signal being given. Because the various signals which can inhibit fault detection (with the exception of the oxygen sensor circuit output signal) arise from what may be characterized as either initial or transient conditions of operation of the engine, it may be generally said that fault detection can occur when the system is operating in the closed-loop mode under a fairly steady operating condition. The reason for supplying the oxygen sensor circuit output signal via diode D119 is to distinguish between the two different conditions which cause the carry out signal to be a logic "one", namely, the integrator counter being either at its maximum count or at its minimum count. With this distinction, fault detection is enabled only when the oxygen sensor indicates that it is a lean mixture which is being sensed.

An alarm is also associated with fault detection circuit 226 to provide an alarm signal to the driver of the vehicle when a fault condition has been detected. The alarm circuit comprises a diode 290, a transistor 292, a resistor 294 and a warning device 296, which in the instant embodiment may take the form of a warning lamp. These elements constituting the alarm circuit are connected as shown in FIG. 17. When the fault signal is given, transistor 292 is switched into conduction to cause lamp 296 to light. The drop in collector voltage of transistor 292 occasioned thereby is coupled back through diode 290 to the junction of capacitor C121 and resistor R116 whereby the capacitor is maintained in an essentially fully charged condition. With capacitor C121 so maintained, the alarm circuit and the fault circuit are effectively latched in a condition indicative of a fault occurrence. Thus, the warning device 296 is continuously energized to provide a continuous indication to the driver that a malfunction has occurred in the system and that the system should be serviced. It will be appreciated that the warning device will be initially extinguished when the vehicle is turned off and then restarted. However, if the fault condition persists, the alarm will again soon be given, and once given, will continue until power to the circuit is removed when the engine is again turned off.

Figure 9:
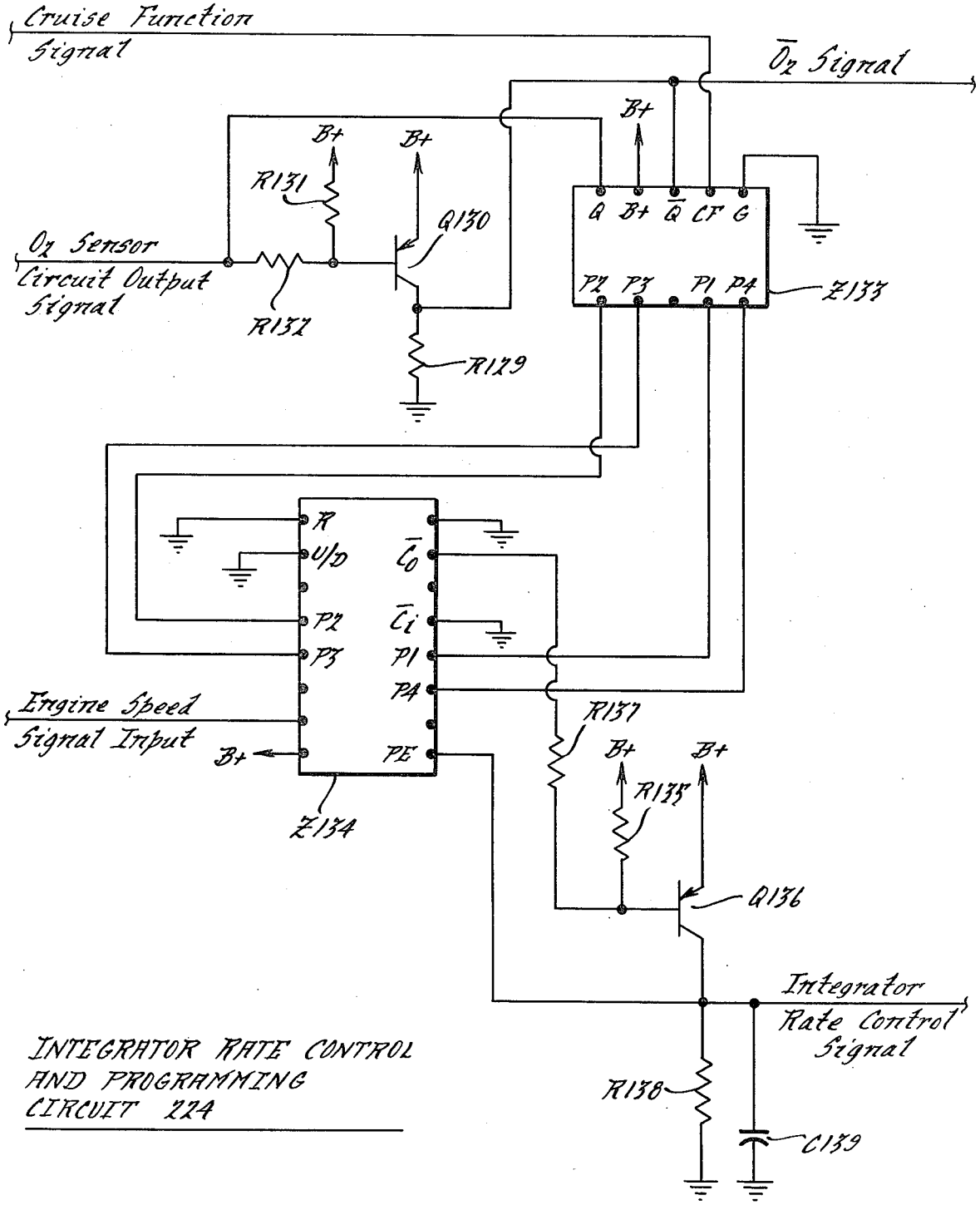

It is now appropriate to direct attention to the details of integrator rate control and programming circuit 224 as shown in FIG. 9. As briefly explained earlier, the integrator rate control signal is primarily a certain number, or numbers, programmed by circuit 224 and the engine speed signal input. It is also at certain times a function of the cruise function signal. However, this latter aspect will be considered in detail later in connection with the description of the cruise function circuit. The circuit 224 may be considered as comprising a programming section and a counter section. The programming section includes a circuit device Z133 and an associated transistor circuit comprising a transistor Q130 and resistors R129, R131, and R132 connected as illustrated. The oxygen sensor circuit output signal is received by the transistor circuit, and the transistor circuit serves the purpose of inverting the level of the oxygen sensor circuit output signal into a complementary signal, referred to as the $\overline{O_2}$ signal. Circuit device Z133 may be considered as having five input terminals designated Q, $\overline{Q}$, B+, CF and G, and four output terminals designated P1, P2, P3, and P4. The oxygen sensor circuit output signal is connected to the Q terminal, and the $\overline{O_2}$ signal is supplied to the $\overline{Q}$ terminal. The B+ terminal connects to B+ potential, the G terminal to ground and the CF terminal to the cruise function circuit. Each output terminal P1, P2, P3 and P4 is intended to provide a corresponding binary output signal whereby a four bit binary word output is provided by circuit device Z133. As will be seen, the value of this word is a function of the specific configuration of one element of circuit device Z133, and the conditions of the respective input signals supplied to terminals Q, $\overline{Q}$ and CF.

The four-bit binary word output of circuit device Z133 is supplied to corresponding inputs (similarly identified) of a counter circuit Z134 which is contained in the counter circuit section of circuit 224. Counter circuit Z134 is a conventional four bit up/down binary counter having the illustrated terminal pin configuration. Certain terminals of the counter are grounded whereby the counter is always caused to count down to an all zeroes state. The engine speed signal input is a pulse type input consisting of pulses whose frequency is related to engine speed. Thus, the rate at which counter Z134 counts down is a function of engine speed. Additional circuitry is associated with circuit Z134 in the counter section of circuit 224. This additional circuitry comprises a transistor Q136, resistors R135, R137, R138 and a capacitor C139 connected as illustrated. The carry out complement terminal $\overline{C_o}$ connects through resistor R137 to the base of transistor Q136. When the counter has counted down to zero, the carry out complement signal goes low causing transistor Q136 to conduct. The collector of transistor Q136 is coupled back to the preset enable terminal PE of counter Z134. Thus when transistor Q136 conducts, the preset enable signal causes the four bit binary word being supplied from circuit device Z133 to be loaded into the counter of counter circuit Z134. When the counter circuit is so loaded, the carry out signal goes high thereby cutting off transistor Q136 and terminating the preset enable signal. Thus, in effect, the preset enable is pulsed when the counter is counted down to zero to cause a new number to be loaded into the counter for subsequent counting down. In this way a repetitive cycle of operation is attained whereby a new number is always loaded into the counter whenever the count reaches zero with the new number being counted down at a rate proportional to engine speed by means of the engine speed signal input. The integrator rate control signal is also taken at the collector of transistor Q136. As can be appreciated, this signal will have the same waveshape as the preset enable signal and therefore exhibits a pulse output at the frequency of the engine speed signal input to counter circuit Z134 divided by the number which has been loaded into counter circuit Z134 from device Z133. As can be appreciated, the integrator rate control signal is therefore inversely proportional to the magnitude of the number loaded into circuit Z134 by device Z133.

The advantages of circuit device Z133 can now be better appreciated. By monitoring the state of the oxygen sensor, it is possible to load different numbers into counter circuit Z134 from device Z133 depending upon the state of the sensor. For example, if it is desired to have the system operate at stoichiometric, the same number if consistently loaded into the counter Z134 regardless of the state of the oxygen sensor. If it is desired to bias the operating point during closed loop operation away from stoichiometric, a different number is loaded into the counter circuit when a lean mixture condition is sensed from that when a rich mixture is sensed. Such modulation has been found advantageous in optimizing fuel economy and performance while minimizing the occurrence of emission spikes in particular noxious constituents of the exhaust gases.

The device Z133 preferably comprises a socket into which is removably inserted a programming element, or header. The socket contains the terminals Q, $\overline{Q}$, B+, G, CF, P1, P2, and P4, and is hard-wired onto the circuit board which contains the system circuitry. The programming element provides a particular interconnection from the inputs to the outputs. In order to better understand and appreciate the advantages of device Z133, consideration of specific examples should be helpful. The design and construction of the programming element serves to establish the operating point at or about stoichiometry at which system operation is desired in the closed loop mode. As explained above, the output signals appearing at terminals P1, P2, P3 and P4 constitute a four bit binary word. By constructing the programming element so that the same binary word is always provided at P1, P2, P3, and P4 regardless of the state of the oxygen sensor circuit output signal or the cruise function signal, the same number will always be loaded into counter Z134. This will make the positive slope of the integrator circuit output signal equal to the negative slope of the integrator circuit output signal for a constant engine speed. This biases the system to operate at stoichiometry. In order to bias the closed loop operating point to other than stoichiometry, it becomes necessary to cause a different value of binary word signal to be loaded into counter circuit Z134 depending upon the state of the sensor. For example, the system can be biased slightly richer than stoichiometric by causing the four bit binary word to have a higher value when the oxygen sensor circuit output signal is indicating a rich condition than when the sensor is indicating a lean condition. For example, the four bit binary may be made equal to a decimal six when the oxygen sensor circuit output signal is high and the binary word may be made equivalent to a decimal four when the oxygen sensor output signal is low. To achieve this mode of operation the programming element would be designed to provide a connection of the B+ terminal to the terminal P3, a connection from the Q terminal to the P2 terminal, and connections of the P1 and P4 terminals to the G terminal. If a leaner than stoichiometric operating point is desired, the number loaded when the oxygen sensor in the rich state is made smaller than that which is loaded when the sensor is in the lean state. Likewise, a leaner operating point can occur when the cruise function signal is given. Thus it can be seen that the programming element provides an advantageous versatility to meet system requirements for a given engine system. A particularly significant advantage of the programming feature is that changes in the operating point can be made without having to perform alteration to the layout of the circuit elements on a circuit board. By designing the socket to receive a conventional integrated circuit package and by designing the programming element as a conventional integrated circuit package, tooling requirements are minimal and apply only to re-programming of the programming element. Changes can be expeditiously accomplished to minimize production lead time.

Figure 18:
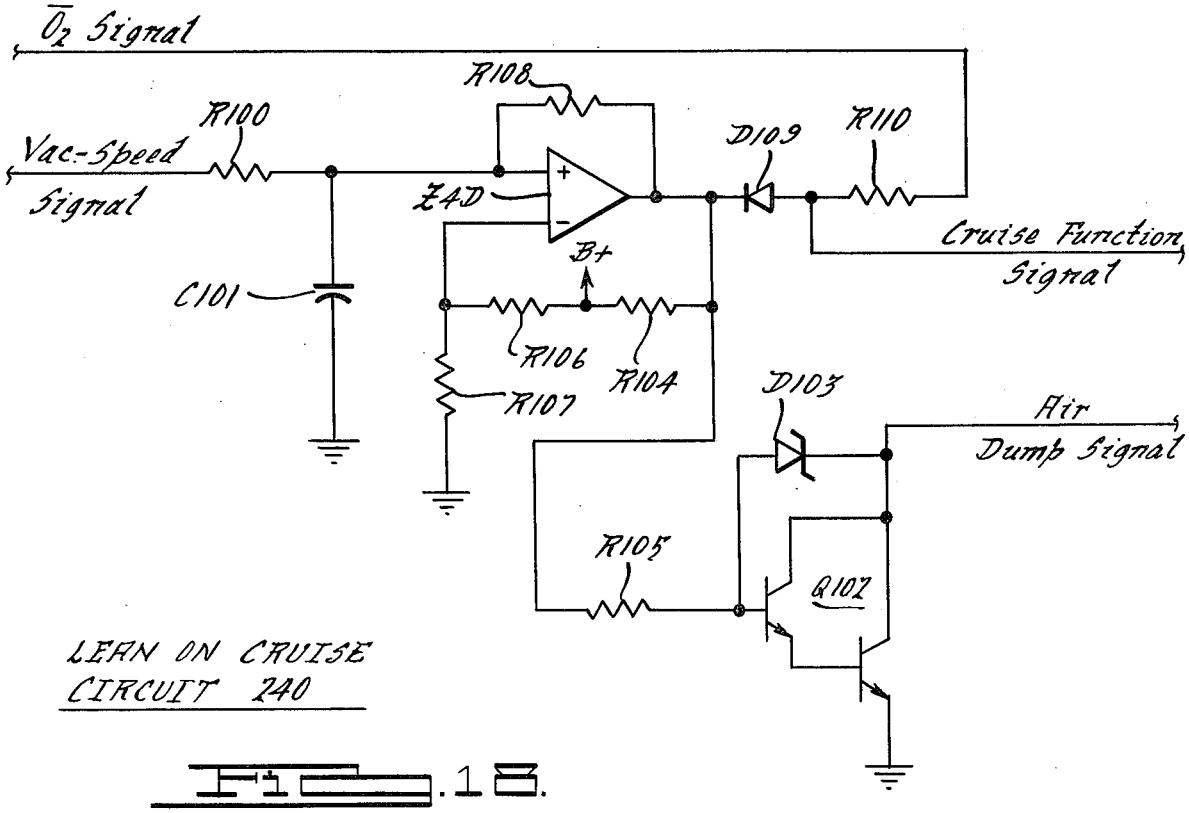

Now that the operation of circuit 224 has been explained more fully, it is appropriate to consider details of lean on cruise circuit 240 as shown in FIG. 18. Circuit 240 comprises a comparator Z4D, resistors R100, R104, R106, R107, R108, R110, capacitor C101 and diode D109 connected as illustrated. The voltage divider provided by resistors R106, R107 supplies a reference signal to the inverting input of comparator Z4D. Resistors R100 and capacitor C101 form an input circuit which couples the vacuum-speed signal to the non-inverting input of the comparator. Resistor R108 couples the comparator output to the non-inverting input to provide switching hysterisis. The output of the comparator is also pulled up to the B+ potential through resistor R104. The $\overline{O_2}$ signal is coupled through resistor R110, and the cruise function signal is taken at the junction of this latter resistor and diode D109. Basically, lean on cruise circuit 240 is a logic circuit which provides the cruise function signal as a logic signal in response to certain conditions of the vacuum speed signal and the $\overline{O_2}$ signal. So long as the vacuum speed signal remains below the reference at the inverting input of the comparator, the output at the comparator provides a ground or "zero" logic signal. For this condition the cruise function signal remains at or at most one diode drop above the potential at the output of the comparator and hence remains low regardless of the condition of the $\overline{O_2}$ signal. Now, if the vacuum-speed signal rises above the reference, the signal at the output of the comparator goes high. Under this condition, the cruise function signal tracks the $\overline{O_2}$. Thus, stated logically, the cruise function signal is high when both the vacuum-speed signal exceeds the reference and the $\overline{O_2}$ signal is concurrently high. As will be appreciated, a cruise condition is indicated whenever the vacuum-speed signal exceeds the reference. The vacuum-speed signal is developed from circuitry like that shown in U.S. Pat. No. 3,978,833 wherein a programmed control signal is a function of both the intensity of the manifold vacuum and the time that the engine has been running in a non-idle condition. That programmed control signal is further modulated by engine speed in the instant embodiment to develop the vacuum-speed signal.

Additional circuitry in FIG. 18 comprises a Darlington transistor Q102, a Zener diode D103 and a resistor R105 connected as shown. The signal from the output of comparator Z4D is coupled through resistor R105 to the base of transistor Q102. When the signal of the comparator output is high, transistor Q102 switches into conduction thereby causing valve 216c to be energized and divert air to atmosphere. Diode D103 functions with respect to this circuit in the same manner as Zener diode D94 does in regulator driver circuit 230. The provision of the air dump signal reduces the load on the engine since it no longer has to inject air into the exhaust system and this yields a still further improvement in fuel economy.

When the cruise function signal is given, a further modification to the number loaded by circuit device Z133 into counter Z134 occurs. Because the cruise function signal is high only when the $\overline{O_2}$ signal is also high, this means that the number loaded into counter Z134 when the $O_2$ sensor circuit output signal is high remains unchanged but that a different number is loaded into the counter when the oxygen sensor circuit output signal is low. It will be recalled that in one example given above, the decimal number six was loaded into the counter when the oxygen sensor circuit output signal was high and the decimal number four was loaded into the counter when the oxygen sensor output signal was low. This 6:4 ratio caused the operating point of the system to be biased richer than stoichiometric. By connecting terminal CF of device Z133 to terminal P4 of the device, the cruise function signal, when given, causes the decimal number twelve to be loaded into the counter when the oxygen sensor circuit output signal is low. This now provides a 6:12 ratio whereby the operating point is shifted to leaner than stoichiometric. Thus, when a cruise condition occurs, the operating point is biased to a leaner than stoichiometric point to yield improvement in fuel economy.

Figure 20:
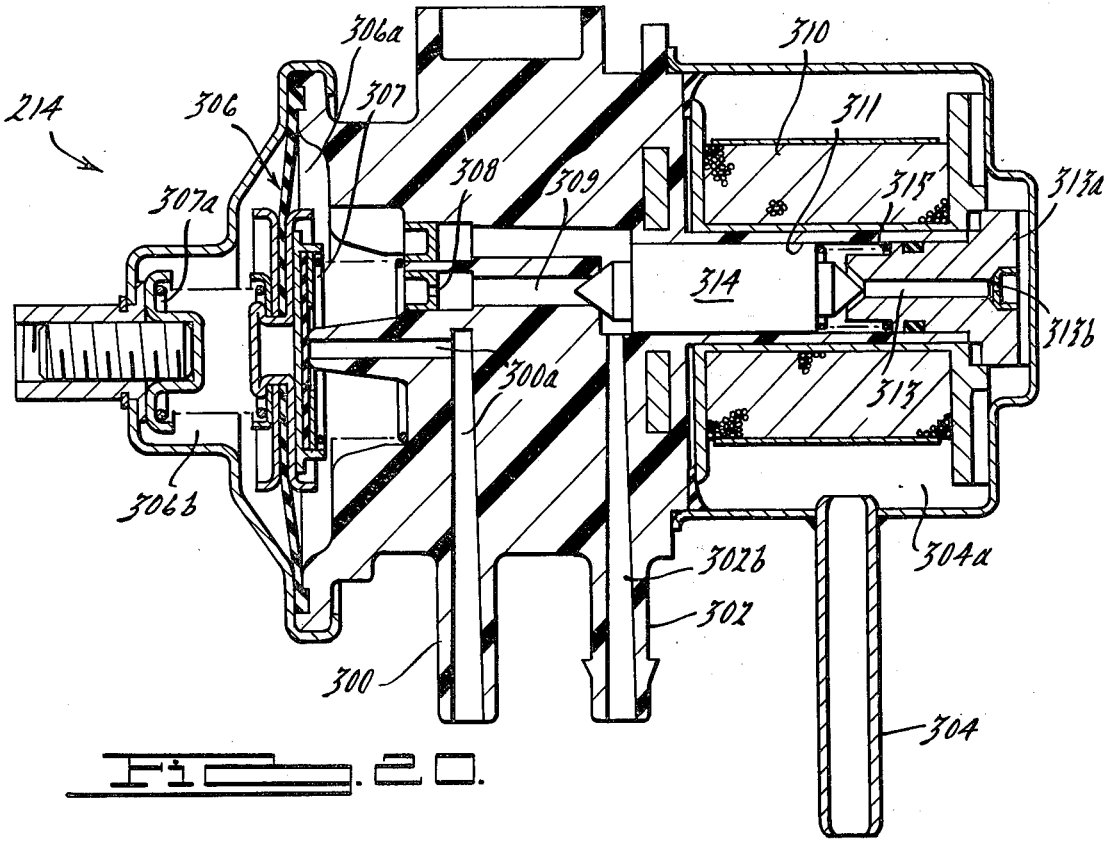
FIGS. 20 and 20A illustrate details of the vacuum regulator shown in FIG. 1.
Figure 20A:
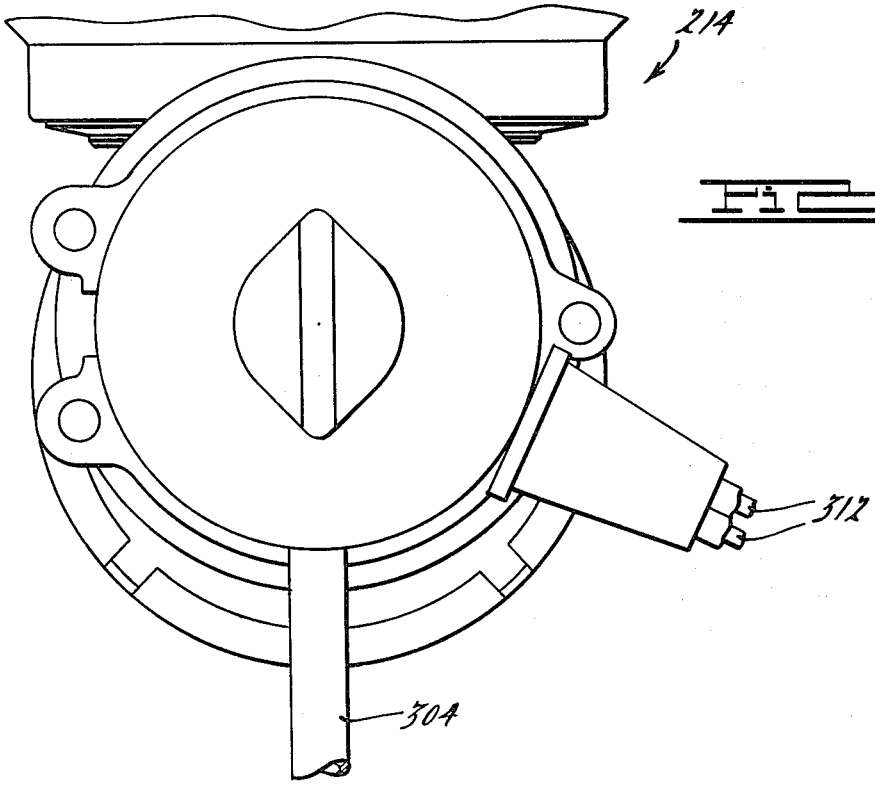

Description of FIGS. 20 and 20A

FIGS. 20 and 20A illustrate details of a vacuum regulator 214 which is suitable for use in a system embodying principles of the invention. Such a regulator is manufactured by Holley Carburetor as Model No. R8353A. Briefly, regulator 214 comprises three nipples, 300, 302 and 304. Nipple 300 is intended to be connected to the engine intake manifold to provide a source of vacuum to the regulator. Nipple 304 is intended to be connected to atmospheric pressure. Nipple 302 is intended to be connected to the carburetor to supply the control vacuum signal thereto.

The structure of the regulator includes a diaphragm assembly 306, which divides a chamber of the regulator into a vacuum chamber portion 306*a* on the right hand side of assembly 306 as viewed in FIG. 20 and a reference chamber 306*b* on the left hand size. A pair of springs 307 and 307*a* are disposed within chambers 306*a*, 306*b*, respectively, to bias assembly 306 in such a manner that the vacuum developed in chamber 306*a* is regulated to a predetermined desired level. The position shown in FIG. 20 illustrates this condition where chamber 306*a* contains vacuum at the regulated level. In the present embodiment this level is 5 inches of mercury as mentioned above. Should the vacuum in chamber 306*a* begin to drop below the regulated level, the resultant force unseats diaphragm assembly 306*a* from the end of passage 300*a* which leads from nipple 300 to chamber 306*a*. Because passage 300*a* is now open, additional vacuum is introduced into chamber 306*a* to restore the vacuum to the regulated level at which point the diaphragm assembly again closes off passage 300*a* so that the regulated vacuum does not increase above this level. Adjustment of the level at which the vacuum is regulated is established by means of the set screw which is threaded into a threaded bore in the left-hand end of the regulator to adjust the bias spring force applied to diaphragm assembly 306.

A passage 309 including an orifice 308 leads from chamber 306*a*. The right-hand end of passage 309 is closed by the left-hand end of an armature valve member 314 with the regulator in the position shown in FIG. 20. With passage 309 thus closed, vacuum cannot pass to passage 302*b* which leads to nipple 302. When armature valve member 314 is displaced to the right, in a manner to be subsequently explained, vacuum can pass from chamber 306*a* through orifice 308 to nipple 302.

Armature valve member 314 is slidably arranged within a bore 311. A spring 315 is disposed between valve armature member 314 and a fitting 313*a* to bias the armature valve member to the position shown in FIG. 20 wherein passage 309 is closed. In this position, the right-hand end of armature valve member 314 is unseated from the left-hand end of fitting 313*a*. Atmospheric pressure which is communicated via nipple 304 to a chamber 304*a* is further communicated through an orifice 313*b* and a passage 313 in fitting 313*a*. Sufficient clearance is provided between armature valve member 314 and bore 311 so that this atmospheric pressure is in turn communicated to passage 302*b* with the regulator in the position indicated.

Displacement of armature valve member 314 is accomplished by means of a solenoid coil 310 terminating in a pair of lead wires 312 one of which is connected to the regulator driver circuit and the other of which is connected to the B+ potential source. The signal supplied from the regulator driver circuit energizes coil 310 with a duty cycle modulated signal. As the duty cycle increases, armature valve member 314 is increasingly displaced to the right to the right as viewed in FIG. 20 against spring 315. As the armature valve member is increasingly displaced to the right from the position shown in FIG. 20, the restriction of passage 309 progressively decreases while that of passage 313 progressively increases so that a correspondingly increasing vacuum signal level is delivered to nipple 302. When the armature valve member is displaced maximally to the right, passage 314 is fully closed and the full strength of the regulated vacuum is transmitted to nipple 302. In the present example, the minimum duty cycle forces the control vacuum to atmospheric pressure (i.e., zero vacuum) while the maximum duty cycle forces it to five inches Hg relative to atmosphere. Within this range, the level of the control vacuum signal is correspondent with the duty cycle signal supplied to solenoid coil 310.

Figure 21:
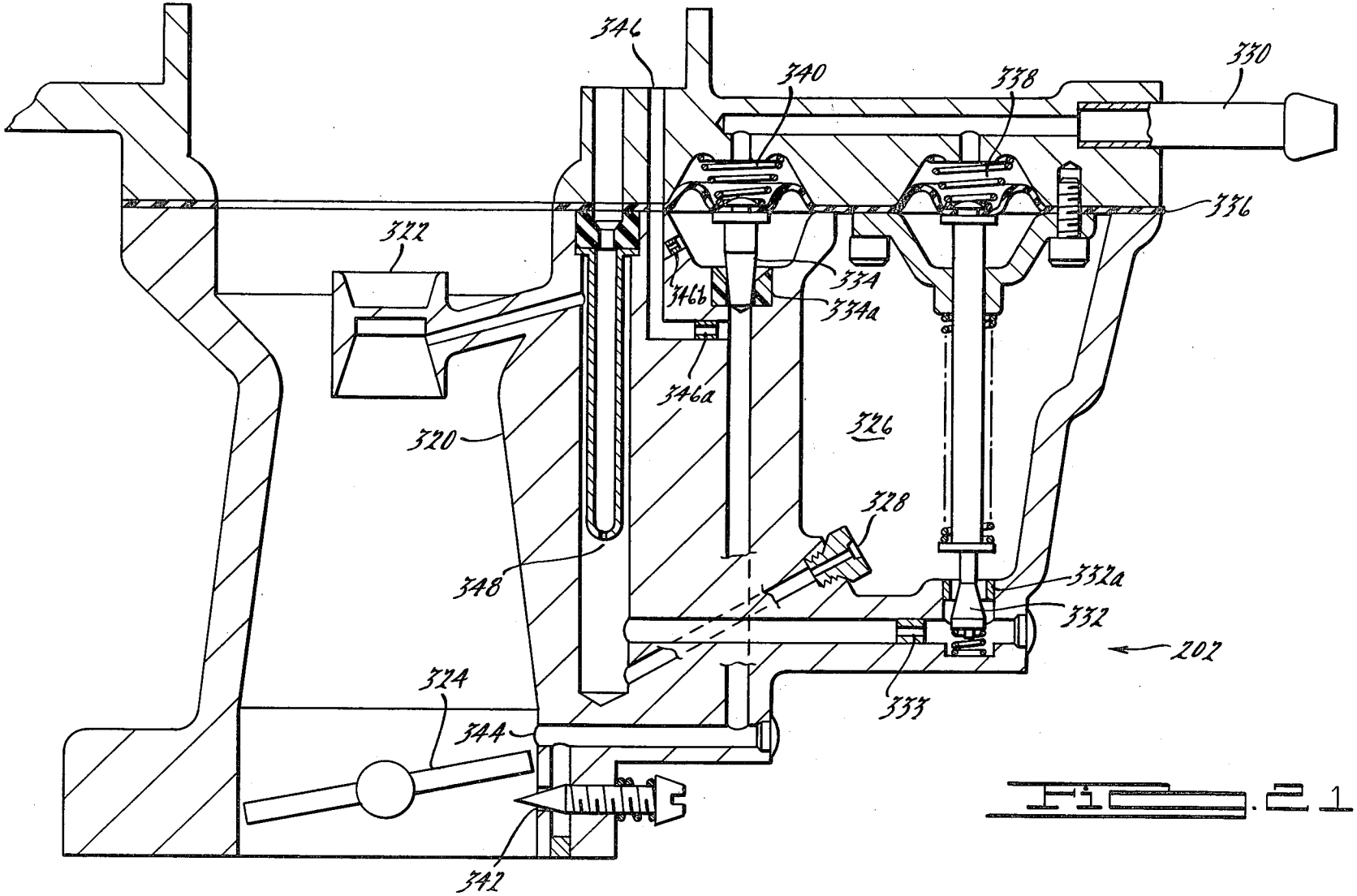
FIG. 21 illustrates detail of the carburetor shown in FIG. 1.

Description of FIG. 21

FIG. 21 illustrates certain detail of a carburetor 202 which is suitable for use in a system of the present invention. The carburetor is manufactured by Holley Carburetor as Model 6145. Briefly, the carburetor comprises a conventional venturi 320, a boost venturi 322, a throttle blade 324 and a fuel bowl 326. A main metering jet 328 serves to conduct fuel into the main well 348 and thence to boost venturi 322. Also associated with the main fuel circuit is a feedback controlled fuel valve 332. Valve 332 is spring-biased to the position illustrated where it is unseated from seat 332*a*. In this position additional fuel from bowl 326 may pass through an orifice 333 to enter well 348. The position of valve 332 is controlled by the control vacuum signal from regulator 214. This control signal is supplied from nipple 302 of regulator 214 to nipple 330 of carburetor 202. The vacuum is communicated to a chamber 338 on one side of a diaphragm formed by a member 336 which controls the position of valve 332. As the intensity of the vacuum signal increases, valve 332 is increasingly displaced upwardly as viewed in FIG. 21 to similarly increasingly restrict the feedback controlled passage.

The carburetor also includes an idle system including an idle air inlet bleed 346 which communicates through an orifice 346*a* to an idle well (not shown but similar to well 348). The idle well in turn communicates with an idle discharge port 342 and an idle transfer slot 344. A feedback controlled idle air bleed valve 334 is also associated with the idle system. Valve 334, like valve 332, is operable by the vacuum control signal applied to nipple 330. However, valve 334 is spring-biased into closure with a valve seat 334*a* when the control vaccum signal is at atmospheric pressure. (FIG. 21 shows the carburetor with the control vacuum at atmospheric pressure.) As the vacuum control signal increases in intensity, valve 334 is increasingly unseated from seat 334*a* so that an additional idle air path is provided through an orifice 346*b* and the feedback controlled valve to the idle system. Thus, for engine operation at and near idle it is primarily valve 334 which controls the air/fuel ratio delivered to the engine while at heavier engine load, it is valve 332 which primarily controls the air/fuel ratio. The carburetor is preferably calibrated to deliver a stoichiometric air/fuel ratio when the intensity of the vacuum control signal is half-way between maximum and minimum; thus as the signal intensity increases above this midpoint, a progressively leaner mixture is developed; and as the signal intensity decreases from this midpoint, a progressively richer than stoichiometric mixture is developed. The carburetor also includes a power enrichment valve (not shown) which is directly coupled with and operable by the accelerator control linkage to inject additional fuel for heavy accelerations. However, the control system, if it is in the closed-loop mode, will typically be switched to open loop by load sensing circuit 236 in response to such extreme load.

Description of the Closed-Loop Mode of Operation

Figure 22:
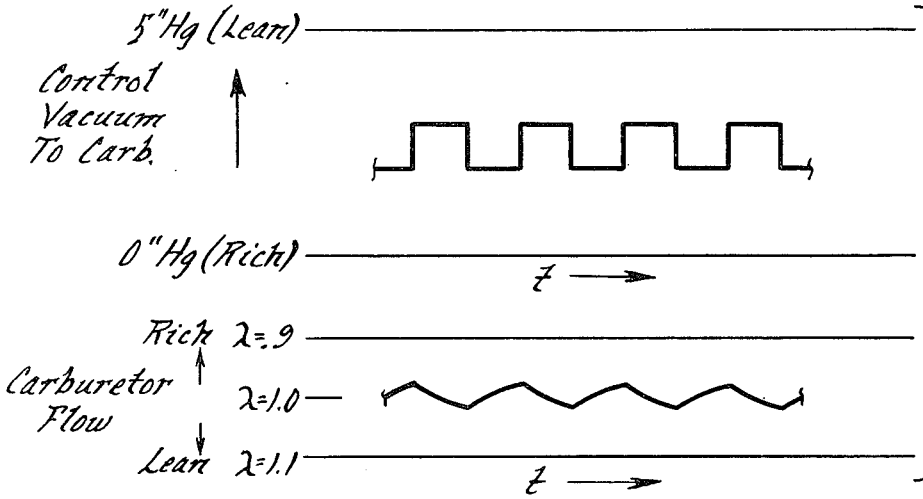
FIG. 22 is a diagram disclosing illustrative idealized waveforms useful in explaining the operation of the system in one particular operating mode.

If it is assumed that the system is in the closed-loop mode with the engine running at a constant speed, the control vacuum signal given by regulator 214 to carburetor 202 and the resultant carburetor flow will be approximately in accordance with the idealized waveshapes shown in FIG. 22. As can be seen in this figure, the control vacuum signal is a rectangular waveshape which is centered at stoichiometric. The carburetor flow will approximate that shown whereby when the control vacuum signal has the higher magnitude, the carburetor will lean the air/fuel mixture while when the control vacuum signal is at the lower value, the carburetor will richen the mixture. Thus, the system of the invention operates to closely control the air/fuel ratio to a range within a narrow window about the desired control level, which in this instance is stoichiometric. The illustrated waveshapes of FIG. 22 will also be characteristic of the system operation within the typical range of engine speeds encountered during normal operation of the vehicle although the frequency will be a function of engine speed. It should be appreciated, however, that transients in engine operation will impart corresponding transients to the control vacuum and resulting carburetor flow.

Figure 23:
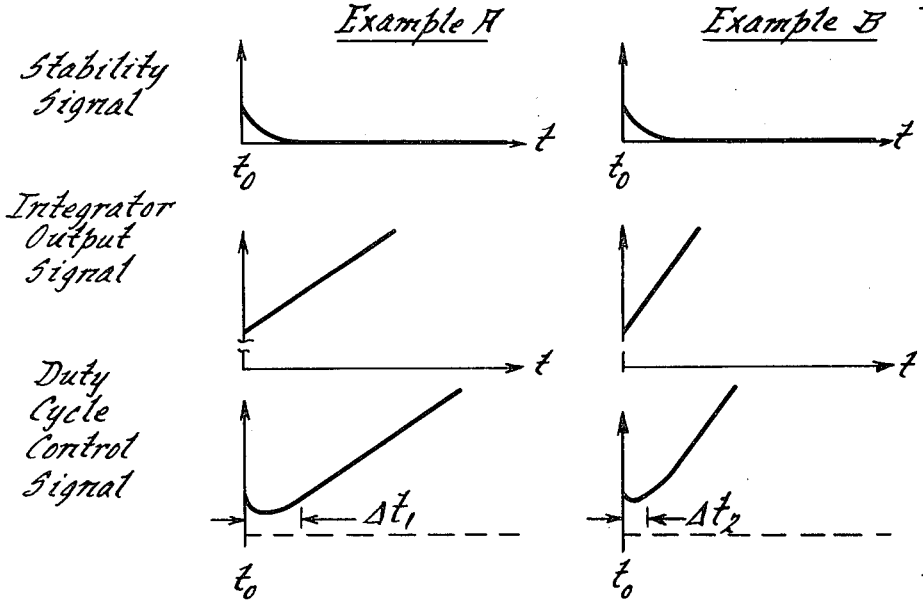
FIG. 23 illustrates additional explanatory waveforms useful in explaining operation of a portion of the system.

A reference was made earlier to the fact that the duty cycle control signal under closed-loop mode of operation is developed from the integrator output signal and the stability signal. It is now appropriate to consider this in greater detail, particularly with reference to FIG. 23. FIG. 23 illustrates two examples, Example A and Example B, each example consisting of three waveshapes. The first waveshape shown is the stability signal; the second is the integrator output signal, and the third is the duty cycle control signal. The primary purpose of FIG. 23 is to illustrate the coaction of the stability signal and integrator output signal in the development of the duty cycle control signal, which represents the commanded air/fuel ratio. The reader will recall from the earlier description of stability circuit 222 that the stability signal is composed of a series of pulses wherein each pulse comprises a sharp jump immediately followed by a decaying exponential transient. Each such pulse occurs in response to an edge of the rectangular oxygen sensor circuit output signal waveform. A positive polarity pulse is developed in response to each positive-going edge of the oxygen sensor circuit output signal waveform and a negative polarity pulse in response to each negative-going edge. The reader will also recall that the integrator output signal may be considered generally as a triangular shaped waveform which ramps in one direction when the oxygen sensor circuit output signal is high and in the opposite direction when the oxygen sensor circut output signal is low. In the two examples of FIG. 23, only a positive pulse of the stability signal and the corresponding ramp of the integrator output signal are shown; however, these are sufficient to illustrate the coaction of the two signals.

Considering now Example A of FIG. 23, the reader will see that the stability signal begins at time $t_o$ being characterized by a sharp positive jump at that time followed by a decaying exponential transient. The magnitude of the jump and the shape of the transient depend upon the particular selection of circuit component values in the stability circuit. The stability signal is given in response to a transition (i.e., an edge) of the oxygen sensor circuit output signal which occurs when the oxygen sensor changes state. In response to the changed state of the oxygen sensor circuit output signal, the integrator output signal begins to ramp in the direction indicated by the integrator output signal waveshape of Example A. The slope of the integrator output signal is a function of both the speed of the engine and the number which is loaded into counter Z134. Let it be assumed for purposes of the example that operation about stoichiometric is desired so that the same number is loaded into counter Z134 regardless of the state of the oxygen sensor. Thus, with this assumption, the slope of the integrator output signal is solely a function of engine speed. The integrator output signal of Example A illustrates a selected engine speed. The duty cycle control signal developed from the summation of the stability signal and the integrator output signal has the shape illustrated. As shown, the duty cycle control signal remains at a level which is in the vicinity of the initial jump in the stability signal for a time interval $\Delta t_1$. After this time interval, the duty cycle control signal follows the integrator output signal since the stability signal transient has completely decayed.

Now, contrast Example B of FIG. 23 with Example A. Example B is given for the same conditions as Example A with one exception and that exception is that the engine is running at a higher speed. The higher speed of the engine will correspondingly cause the integrator output signal to have a steeper slope. The stability signal remains unchanged. Now, the duty cycle control signal remains in the vicinity of the initial jump in the stability signal for a shorter time interval $\Delta t_2$. As will be apparent from comparison of the two examples, the interval $\Delta t_2$ is approximately proportionally smaller than the interval $\Delta t_1$ in the proportion of speed difference between the two examples. Thus, with this aspect of the invention, a speed factor is introduced into the duty cycle control signal whereby the duration for which the duty cycle control signal is maintained in the vicinity of the initial jump in the stability signal in response to a change in state in the oxygen sensor is made inversely proportional to engine speed. By appropriate section of the circuit component values, this duration may be made equal to the transport time required for flow from the carburetor to pass through the engine to the oxygen sensor. This means that in response to a change in state in the oxygen sensor, a predetermined change in the control vacuum signal to the carburetor is given and maintained for a time interval sufficient to allow for the effect of the change to be sensed by the oxygen sensor. Such will be true over the typical range of engine speeds which are customarily encountered. The amount of the change, which again is a function of the selection of circuit component values, is calculated to be just enough to cause the oxygen sensor to switch back to its prior state, assuming a reasonably steady state operation of the engine. Thus, at the end of the $\Delta t_1$ or $\Delta t_2$ interval, the change in state of the oxygen sensor will, under such a steady state condition, cause an opposite polarity pulse of the stability signal to be generated and the integrator output signal to ramp in the opposite direction. As a consequence, the duty cycle control signal at the end of the $\Delta t_1$ or $\Delta t_2$ interval will experience a corresponding jump in the opposite direction and will be likewise maintained in the vicinity of that level for a time interval corresponding to the $\Delta t_1$ or $\Delta t_2$ interval. The amount of this jump is calculated to cause the oxygen sensor to change state again and in this way a repetitive, somewhat rectangular waveshaped duty cycle control signal is actually developed which in turn develops the corresponding control vacuum signal shown in FIG. 22. In this way, the carburetor flow is closely controlled about the desired operating point which in the instant example is stoichiometric.

Figure 24:
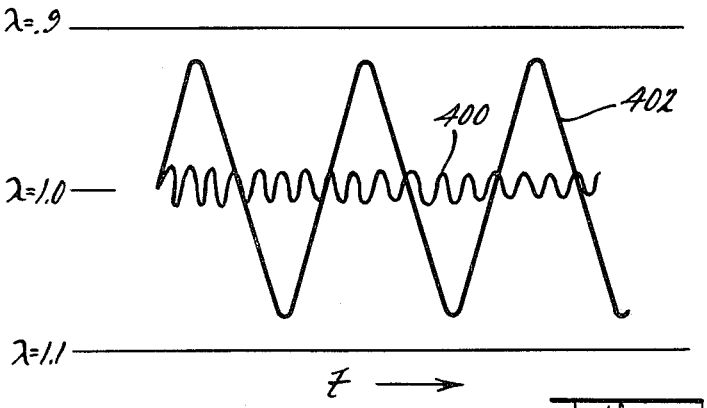
FIG. 24 illustrates a comparison of two idealized waveforms to demonstrate the benefit of the invention in providing more precise control of the air/fuel ratio.

FIG. 24 illustrates a relative comparison of the operation of the system of the present invention with other types of systems. With the present invention, the waveform 400 illustrates the resultant carburetor flow with the system of the present invention whereas the waveform 402 illustrates the typical carburetor flow which might be achieved with other types of systems. As can be seen, the present system is characterized by a smaller amplitude but higher frequency type of modulation of carburetor flow. Thus, the air/fuel mixture is regulated within a relatively narrow window to provide more precise control of emission products and thereby maximize the efficiency of certain types of catalysts.

As pointed out above, the lean on cruise function can come into play when the system is in the closed-loop made of operation and a cruise condition occurs. Because a larger number is loaded into counter Z134 when the oxygen sensor senses a lean mixture than is loaded when a rich mixture is sensed, the integrator output signal for a given engine speed will have a smaller slope when a lean mixture is sensed than when a rich mixture is sensed. In effect then, this makes the system correct more quickly for a rich mixture condition than a lean mixture condition and will operate to bias system operation to somewhat leaner than stoichiometric.

Figure 25:
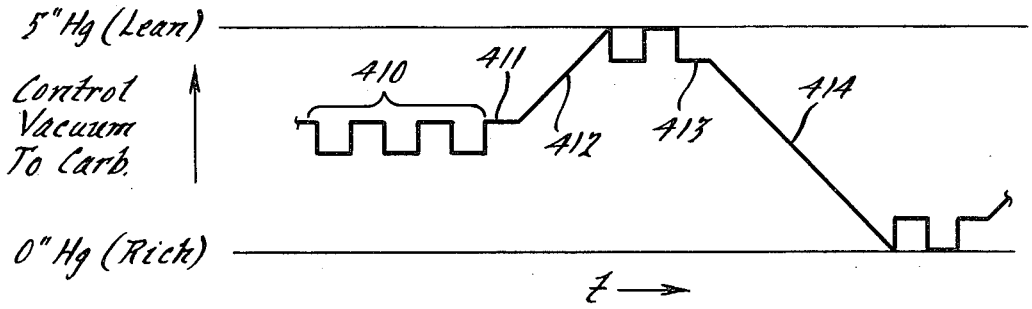
FIG. 25 is an illustrative idealized waveform useful in explaining system operation in response to transients.

While in the closed-loop mode, the system may encounter transient conditions which are not severe enough to interrupt the closed-loop mode, yet which can cause changes in the control vacuum waveshape from that shown in FIG. 22. FIG. 25 illustrates an idealized waveform example of a hypothetical closed-loop operation in response to transient conditions. It is assumed initially in FIG. 25 that the system is operating in a fairly steady condition in the vicinity of stoichiometric, as indicated by the reference numeral 410. A change in engine load then occurs which causes the system to lean the air/fuel ratio. Because the change 411 is insufficient to cause the sensor to switch state, the control vacuum to the carburetor is progressively increased along the segment 412 until it reaches the maximum five inches of mercury (i.e., 5" Hg). The control signal may remain in the vicinity of five inches of mercury for one or two cycles. If the engine load now changes such that a richer mixture is called for, and the change 413 is insufficient, then the control vacuum follows the segment 414 toward the lower limit zero inches of mercury. The two segments 412 and 414 are caused solely by the integrator output signal since the corresponding stability pulses would have decayed previously. It should be pointed that the FIG. 25 waveform is merely to illustrate the range of control of the system with idealized waveshapes and is not intended to necessarily represent an actual operating situation which might be encountered.

Figure 26:
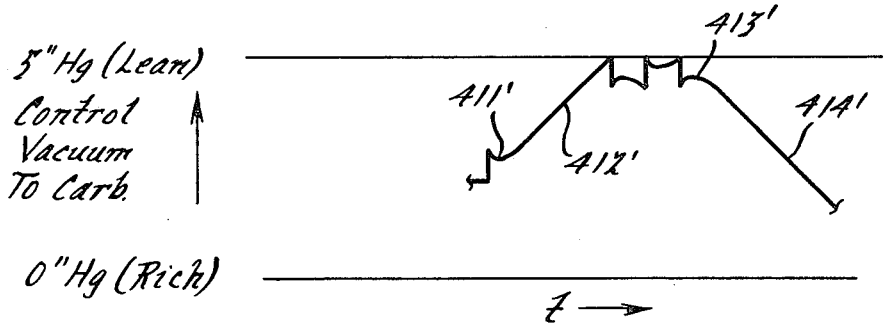
FIG. 26 is an illustrative waveform of a portion of the waveform of FIG. 25 illustrating more realistic detail.

FIG. 26 represents a more realistic waveshape similar to a portion of the waveshape of FIG. 25. In FIG. 26, the primed numbers correspond to their unprimed counterparts in FIG. 25. The segment 411' would correspond to the allowed transport time 411 in FIG. 25 and similarly the segment 413' to the segment 413 in FIG. 25, both segments 411', 413' showing the more representative shape described in FIG. 23.

Figure 27:
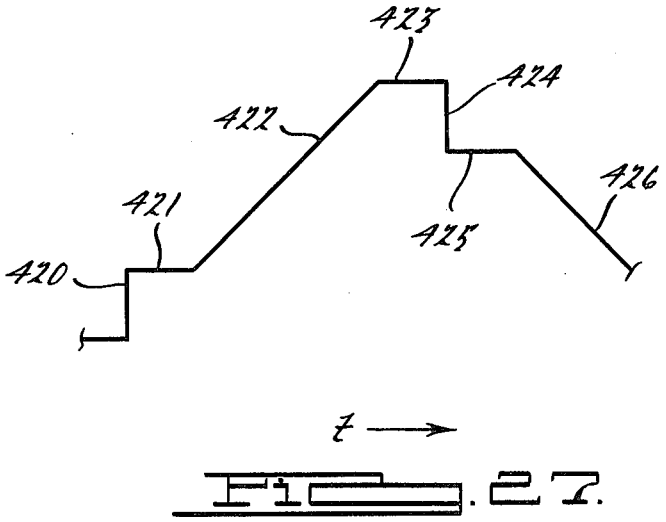
FIG. 27 is an idealized waveform useful in further explaining the operation of the system.

FIG. 27 is an idealized waveform characterizing the possibilities for specific shapes of the duty cycle control signal. The segment 420 corresponds to the jump in the stability signal and the segment 421 corresponds to the allowed transport time for which that initial jump is maintained. The segment 422 corresponds to the condition after the transport time interval where the integrator output signal controls. The segment 423 would represent the signal having reached the lean limit of control. The segment 424 corresponds to the initial jump in response to a negative pulse of the stability signal. The segment 425 corresponds to the transport time interval which ensues after that jump 424. The segment 426 corresponds to the ensuing control by the integrator output signal where the control signal is heading toward the lower limit of control. It should be appreciated that FIG. 27 represents the possibilities for the shape of the control vacuum signal. However, the actual shape of the control vacuum signal may correspond to only portions of the FIG. 27 example. As noted above, where the engine is operating in a steady state about stoichiometric, the waveshape will appear like waveshape 410 in FIG. 25. Where a minor, not too extreme, transient condition is encountered, the initial correction afforded by segments 420, 421 and 424, 425 may not be sufficient to cause the sensor to change state. In these instances, a portion of the segments 422 or 426 will appear in the waveshapes. However, each time that the sensor changes state, the segments 420, 421, or 424, 425, as the case may be, are always allowed to occur although the durations of the segments 421, 425 may be very brief at higher engine speeds. For more extreme conditions, the signal will ramp to either the upper or lower rail and may remain there for a duration of time depending upon the severity of the extreme condition. For very extreme conditions, the system will revert to an open-loop mode of operation and the integrator signal will be locked. It can thus be seen that inclusion of the stability circuit, in conjunction with the integrator circuit, provides for a significant improvement in control capability.

Figure 28:
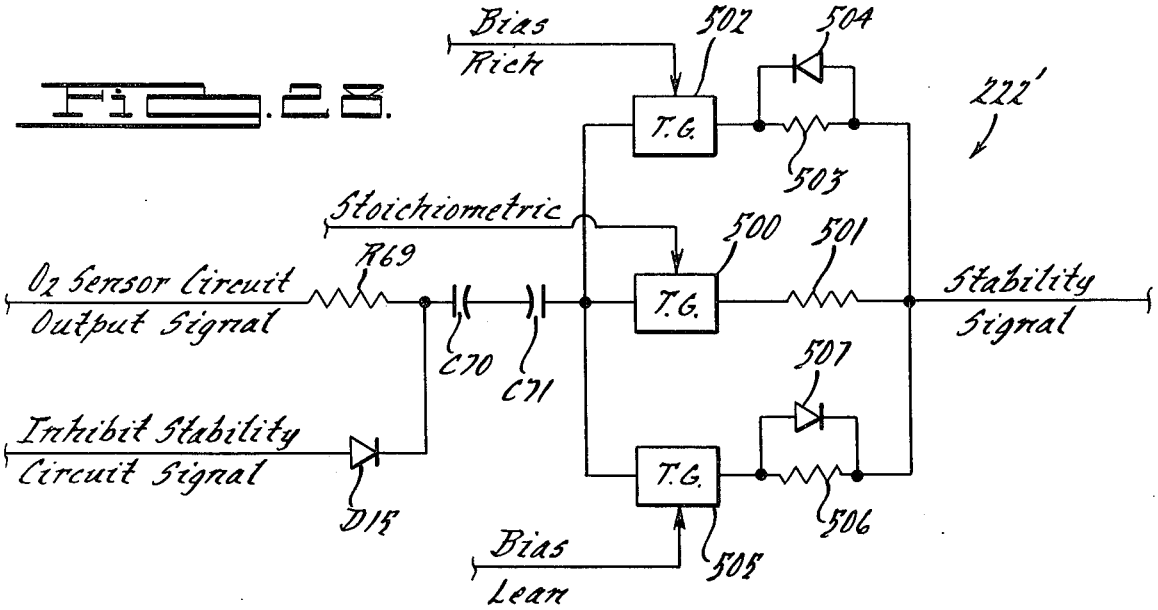
FIG. 28 is an electronic schematic diagram illustrating details of an alternate circuit construction which may be used in one of the blocks shown in FIG. 2.

For certain engines it may be desirable to provide for biasing of the system at stoichiometric, richer than stoichiometric or leaner than stoichiometric. It was earlier explained how programming device Z133 could provide this capability. It is also possible to achieve this capability by a modified stability circuit. FIG. 28 is an example of such a stability circuit 222'. Circuit 222' is like circuit 222 except that circuit 222' comprises between capacitor C71 and the input to summing circuit 225 three parallel gated circuits. The first circuit comprises a transmission gate 500 in series with a resistor 501. The second circuit, a transmission gate 502 in series with the parallel combination of a resistor 503 and a diode 504. The third circuit, a transmission gate 505 in series with the parallel combination of a resistor 506 and a diode 507. As shown, each of the three transmission gates 500, 502, 505 is controlled by a respective control signal: stoichiometric, bias rich, and bias lean, respectively. The stoichiometric control is used to gate transmission gate 500 when it is desired to produce positive and negative stability pulses having equal amplitudes and time constants. In this instance, the circuit would be essentially identical in function to circuit 222. Transmission gate 505, when activated by a bias lean signal, will switch resistor 506 and diode 507 into the circuit. This will cause the positive-going transitions of the oxygen sensor circuit output signal to have a larger amplitude than the negative-going transitions. This will tend to bias the system somewhat leaner than stoichiometric. Transmission gate 502, when activated by a bias rich signal, will switch diode 504 and resistor 503 into the circuit. Diode 504 is connected in reverse polarity relative to diode 507. When the diode 504 and resistor 503 are switched into the circuit, the negative-going transitions in the oxygen sensor circuit output signal have a larger amplitude than do the positive-going transitions. This will cause the system to be biased somewhat slightly richer than stoichiometric. In this way the stability signal may be selectively controlled whereby the operating point of the system may be similarly selectively biased to stoichiometric, to somewhat richer than stoichiometric, or to somewhat leaner than stoichiometric.

Figure 29:
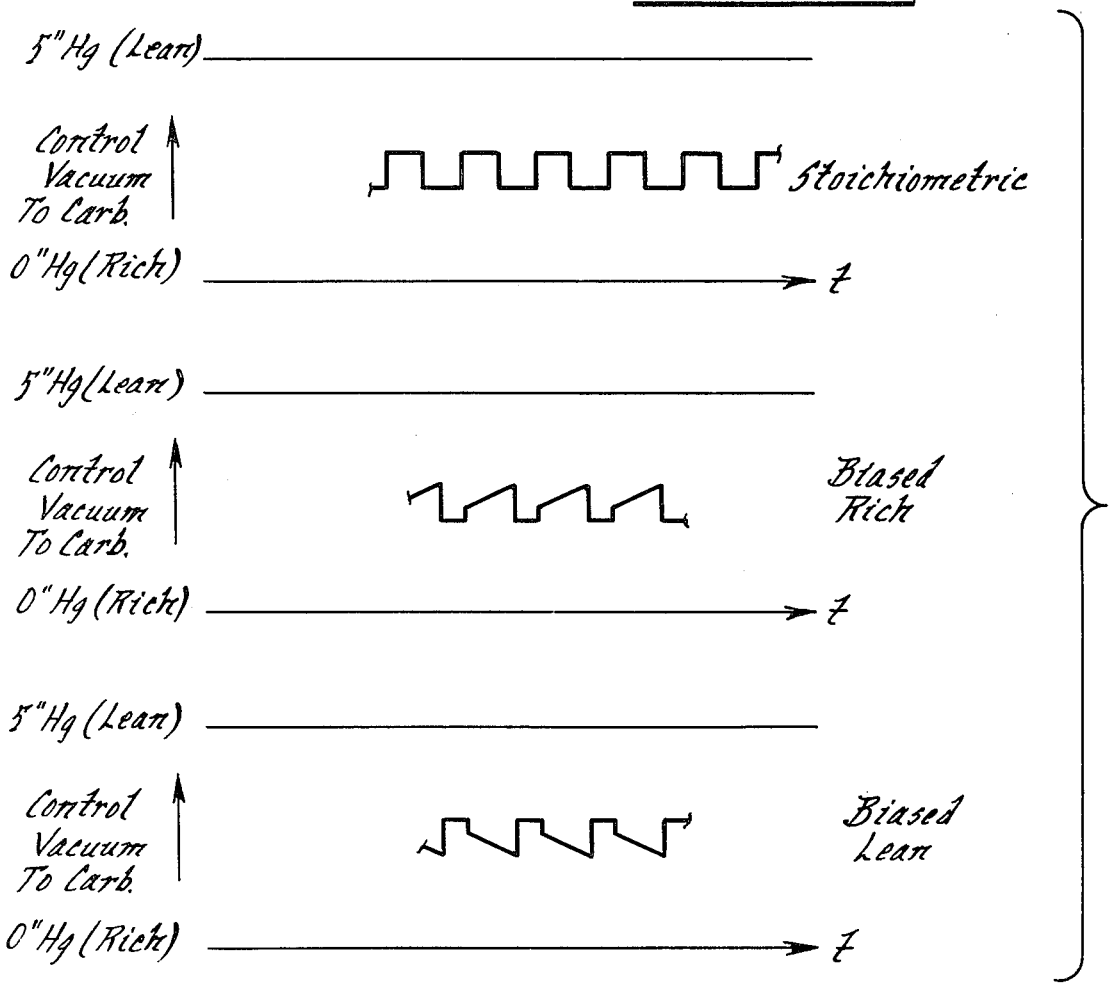
FIG. 29 is a series of illustrative idealized waveforms useful in explaining the operation of the circuit of FIG. 28.

FIG. 29 illustrates typical idealized waveshapes of the control vacuum signal which may be developed in a system incorporating the stability circuit of FIG. 28. The first waveform illustrates the waveshape for a steady running condition where the stoichiometric transmission gate 500 is activated to put resistor 501 into the circuit. In this instance it can be seen that the leading and trailing edges of the signal are equal. The second waveshape of FIG. 29 illustrates the operation when the transmission gate 502 is activated to switch resistor 503 and diode 504 into the circuit. Here it can be seen that the positive-going transitions are much smaller than the negative-going transitions. Thus, it can be seen that the system spends a greater percentage of time with the sensor in the rich condition than in the lean condition, thus biasing the system rich. The third waveform of FIG. 29 illustrates the operation when transmission gate 505 is activated to bring diode 507 and resistor 506 into the circuit. Here it will be noted that the sensor is in the lean condition a larger proportion of the time than it is in the rich condition, thus biasing the system lean. As will be appreciated the selection of the specific component values, particularly for the resistors, is chosen to provide for the desired type of operation and the relative amount of biasing of the system.

Open-Loop Mode of Operation

As referred to earlier, there are various conditions which will create an open-loop mode of operation. Briefly, these may be categorized as falling into either one of two groups. One, a starting conditions group and two, a transient conditions group. Included in the former group are the conditions engine cold and after start timer not timed out. These two conditions are monitored by coolant temp circuit 232 and after start timer circuit 234, respectively. The occurrence of either of these two conditions is by itself sufficient to prevent the closed-loop mode of operation from occurring. Included in the transient conditions group are conditions of suddenly increased or suddenly reduced engine load. These two conditions are monitored by engine load sensing circuit 236 and lean on decel circuit 238, respectively.

An important operating feature of the invention occurs when a closed-loop mode of operation is interrupted in favor of an open-loop mode. This feature relates to the locking of integrator circuit 220 by one of the lock integrator signals. As disclosed in FIG. 5, the lock integrator signals are coupled through the illustrated diodes to the clock inhibit terminal $C_i$ of device Z81. When one of the lock integrator signals is given, the clock inhibit signal prevents further pulses supplied to terminal $f_i$ from being counted by the counter of the integrator. This means that the integrator output signal remains at the level existing just prior to the occurrence. of the lock integrator signal causing the clock inhibit. Only when all lock integrator signals cease is the counter of the integrator again permitted to count pulses at terminal $f_i$ so that the integrator output can now begin to change. Thus, when closed-loop operation resumes after an open-loop interruption, the integrator output signal is at the same level as it was at prior to the interruption. As a consequence, a minimum of hunting, if indeed any at all, is needed for the correct closed-loop operating point to be once again attained. This feature is beneficial in that less emissions will be generated in the return from open to closed loop.

When open-loop mode is caused by either engine load sensing circuit 236 or lean on decel circuit 238, a corresponding override signal is given to regulator driver 230. For the engine load sensing circuit, the override signal is the go rich override which causes the control vacuum signal supplied to the carburetor by the vacuum regulator to drop to zero inches of mercury thereby permitting the carburetor to develop as rich a mixture as possible. In the case of the lean on decel circuit, the override signal is the go lean override which causes the control vacuum signal to be at its maximum five inches of mercury thereby causing the carburetor to develop as lean a mixture as possible. Thus, each override signal will correspondingly override the duty cycle signal supplied to the regulator driver circuit 230. In normal operation the two override signals would obviously never occur simultaneously.

When the open loop mode of operation is caused by one of the starting conditions, integrator 220 is similarly locked. In this situation (assuming neither the go rich override signal nor the go lean override signal is given) it is the gated analog coolant temp signal which controls the vacuum signal supplied to the carburetor because gate 242 permits transmission of the analog coolant temp signal directly as the input to the summing circuit 225. If either circuit 236 or circuit 238 gives the corresponding override signal, while one of the starting conditions is causing open-loop operation, then that override signal will override the gated analog coolant temp signal in commanding the air/fuel ratio. While in the instant embodiment the analog coolant temp signal will cause the carburetor mixture to become progressively leaner as the engine warms up, it is clearly possible to provide any type of warm up schedule which is desired before the closed-loop mode of operation occurs. For example, just the opposite might be required, namely, that the mixture becomes progressively richer as the engine warms up. It should be pointed out that starting of the engine always causes the integrator counter to be reset. Thus, when the starting conditions which were causing the open-loop have terminated and closed-loop operation begins, the integrator signal starts at its minimum level.

When the open-loop mode of operation occurs it will be noted that an inhibit fault detection signal is given to inhibit fault detection circuit 226. This means that the fault detection circuit is operative only in the closed-loop mode of operation. Also, the idle signal and the exhaust temperature signal are used to inhibit fault detection for the reasons given above. When a fault indication is given by fault detection circuit 226, the integrator output signal will be at a level which by itself would tend to cause as rich a mixture as possible. The fault signal is supplied to summing circuit 225 and is of such a value that when it is summed with the integrator output signal there is provided a desired duty cycle for the duty cycle signal which should not thereafter change so long as the fault condition continues because the integrator signal will remain unchanged. Neither the stability signal nor the gated analog coolant temp signal will contribute to the duty cycle signal during the existence of the fault.

It will be further noted that it is unnecessary for engine load sensing circuit 236 and lean on decel circuit 228 to inhibit the stability circuit because of the corresponding overriding signal which each gives.

While the foregoing disclosure contains a preferred embodiment according to the best mode presently contemplated in carrying out the invention, it will be appreciated that the scope of the invention contemplates other embodiments. For example, principles of the inventions may be applied to closed-loop systems using fuel injectors or fuel metering devices rather than a carburetor. Other types of carburetors and regulators may be used. The use of electronic microprocessors for the control circuitry is also contemplated. With a microprocessor, it will be possible to more accurately develop waveshapes to essentially duplicate the idealized waveshapes referred to above. Also, a microprocessor will minimize the amount of electronic hardware required.

What is claimed is:

1. In an internal combustion engine wherein a combustible air/fuel mixture is introduced into combustion chambers of the engine and combusted therein and products of combustion are exhausted from the combustion chambers, and the air/fuel ratio of the mixture is controlled by a closed-loop regulated air/fuel ratio control having a sensor sensing predetermined compositions of the products of combustion and exhibiting a change from one state to another correlated with a predetermined change in the composition of the products of combustion, means adjusting the air/fuel ratio of the combustible mixture and control means closed-loop coupling said sensor and said adjusting means, the improvement in said control means comprising: means responsive to each change in state of said sensor for always immediately effecting a predetermined increment of change in the setting of said adjusting means to a setting calculated to return said sensor, under reasonably steady state operation of the engine, to the sensor's immediately preceding state upon elapse of the transport time required for the effect of the change in the setting to be detected by said sensor and for holding the setting of said adjusting means substantially at its incremented value for a time interval essentially equal to that of the transport time, and means effective at the conclusion of said time interval if said sensor has not yet returned to its immediately preceding state for progressively increasing the setting of said adjusting means beyond that established by said predetermined increment of change until said sensor does return to its immediately preceding state.

2. In an internal combustion engine wherein a combustible air/fuel mixture is introduced into combustion chambers of the engine and combusted therein and products of combustion are exhausted from the combustion chambers, the method of closed-loop regulating the air/fuel ratio by an air/fuel ratio control having a sensor sensing predetermined compositions of the products of combustion and exhibiting a change from one state to another in response to a predetermined change in composition of the products of combustion, and means adjusting the air/fuel ratio of the combustible mixture in accordance with the state of said sensor, said method comprising: always immediately effecting a predetermined increment of change in the setting of said adjusting means to a setting calculated to return said sensor, under reasonably steady state operation of the engine, to the sensor's immediately preceding state upon elapse of the transport time required for the effect of the change in the setting to be detected by said sensor, holding the setting of said adjustment means substantially at its incremented value for a time interval essentially equal to the transport time, and at the conclusion of said time interval progressively increasing the setting of said adjusting means beyond that established by said predetermined increment of change if said sensor has not yet returned to its immediately preceding state and continuing to progressively increase the setting of said adjusting means until said sensor does return to its immediately preceding state.

3. In an internal combustion engine wherein a combustible air/fuel mixture is introduced into combustion chambers of the engine and combusted therein and products of combustion are exhausted from the combustion chambers, and the air/fuel ratio of the combustible mixture is controlled by a closed-loop regulated air/fuel ratio control having sensing means sensing predetermined compositions of the products of combustion for providing a rectangular waveform signal in accordance therewith, means adjusting the air/fuel ratio of the combustible mixture, and control means closed-loop coupling said sensing means and said adjusting means, said control means including an integrator controlled by said sensing means providing an integrator signal which ramps in one direction when said rectangular waveform signal is high and which ramps in the opposite direction when said rectangular waveform signal is low, and means controlling the rate of the integrator with engine speed, the improvement comprising: stability circuit means coupled with said sensing means comprising means always responsive to each transition of said rectangular waveform signal for always immediately providing a corresponding pulse whose polarity corresponds to the direction of the corresponding transition and which comprises an initial increment and ensuing transient decay thereof, and means summing the pulses of said stability circuit means and said integrator signal together algebraically to form a command signal, and means controlling the setting of said adjusting means in accordance with said command signal, said stability circuit means and said integrator being so constructed that when their respective outputs are summed together by said summing means the command signal exhibits a characteristic effective to cause the setting of said adjusting means to be changed in response to each transition in said rectangular waveform signal by a predetermined amount calculated to return said rectangular waveform signal, under reasonably steady state operation of the engine, to the level existing immediately prior to the transition upon elapse of a time interval essentially equal to the transport time required for the effect of the transition to be detected by said sensing means, and hold the setting of said adjusting means substantially at its changed setting for said time interval, and then at the conclusion of said time interval, if said rectangular waveform signal has not yet returned to the level existing immediately prior to the transition, progressively increase the setting of said adjustment means beyond that established by said predetermined amount until said rectangular waveform signal does return to the level existing immediately prior to the transition.

4. In an internal combustion engine wherein a combustible air/fuel mixture is introduced into combustion chambers of the engine and combusted therein and the products of combustion are exhausted from the combustion chambers, and the air/fuel ratio of the mixture is controlled by a closed-loop regulated air/fuel ratio control having means sensing predetermined compositions of the products of combustion, means adjusting the air/fuel ratio of the combustible mixture and control means closed-loop coupling said sensing means and said adjusting means, the improvement in said control means comprising: means providing a command signal representative of a desired setting of said adjusting means to create a corresponding desired air/fuel ratio of the combustible mixture, a duty cycle control circuit receiving said command signal and developing a corresponding duty cycle control signal, a solenoid coil which is duty-cycle operated to control the setting of said adjusting means, and means coupling said duty cycle circuit and said solenoid coil comprising a transistor driver circuit including a driving transistor having base, emitter and collector electrodes, means serially connecting the emitter-collector circuit of said transistor and said solenoid coil across a source of energizing potential, means coupling the base-emitter circuit of said transistor to said duty cycle circuit to cause the duty cycle signal to be applied across said base and emitter electrodes and thereby subject said transistor to duty cycle operation to similarly duty cycle said solenoid coil, a zener diode, means connecting the anode of said zener diode to said base electrode, and means connecting the cathode of said zener diode to the junction at which said solenoid coil and the emitter-collector circuit of said transistor are serially connected.

5. In an internal combustion engine wherein a combustible air/fuel mixture is introduced into combustion chambers of the engine and combusted therein and products of combustion are exhausted from the combustion chambers and the air/fuel ratio of the combustible mixture is controlled by a closed-loop regulated air/fuel ratio control having means sensing predetermined compositions of the products of combustion, means adjusting the air/fuel ratio of the combustible mixture and control means, including control circuitry on a circuit board, closed-loop coupling said sensing means and said adjusting means, the improvement in said control means comprising: a programming device which establishes that air/fuel ratio about which the air/fuel ratio of the mixture is closed-loop regulated, said programming device comprising a first element having a plurality of terminals which are hard-wired onto said circuit board into that portion of the control circuitry which establishes the air/fuel ratio about which the air/fuel ratio of the mixture is closed-loop regulated, a first set of said terminals being inputs and a second set of said terminals being outputs, and a second element which is removably engaged with said first element, said second element comprising a first set of terminals mated with the first set of terminals of said first element and a second set of terminals mated with the second set of terminals of said first element, said second element comprising a plurality of direct conductive paths from selected ones of said first set of terminals thereof to selected ones of said second set of terminals thereof whereby the conductive paths establish selected circuits from selected input terminals of said first element to selected output terminals of said first element and thereby program that air/fuel ratio about which the air/fuel ratio of the mixture is closed-loop regulated.

6. In an internal combustion engine wherein a combustible air/fuel mixture is introduced into combustion chambers of the engine and combusted therein and the products of combustion are exhausted from the combustion chambers, and the air/fuel ratio of the combustible mixture is controlled by a closed-loop regulated air/fuel ratio control having means sensing predetermined compositions of the products of combustion, means adjusting the air/fuel ratio of the combustible mixture, control means closed-loop coupling said sensing means and said adjusting means, means for interrupting the closed-loop control of said adjusting means by said sensing means in favor of an open-loop mode of control of said adjusting means in response to a predetermined condition, and means for detecting failure of said sensing means, the improvement in said means for detecting failure of said sensing means comprising: means for determining (1) that the closed-loop control of said adjusting means by said sensing means has not been interrupted in favor of an open-loop mode of control, (2) that said sensing means is giving an indication of a selected predetermined composition, (3) that the temperature of the products of combustion is above a selected temperature, (4) that the engine is running in a non-idle condition, and (5) that the control is commanding a mixture which would cause said sensing means to give an indication different from that which it is in fact giving and means for giving a fault indication in response to the determination of the concurrence of the foregoing five conditions for a predetermined time period.

7. In an internal combustion engine wherein a combustible air/fuel mixture is introduced into combustion chambers of the engine and combusted therein and products of combustion are exhausted from the combustion chambers, and the air/fuel ratio of the combustible mixture is controlled by a closed-loop regulated air/fuel ratio control having means sensing predetermined compositions of the products of combustion for providing a rectangular waveform signal in accordance therewith, means adjusting the air/fuel ratio of the combustible mixture, and control means closed-loop coupling said sensing means and said adjusting means, said control means including an integrator controlled by said sensing means providing an integrator signal which ramps in one direction when said rectangular waveform signal is high and which ramps in the opposite direction when said rectangular waveform signal is low and means controlling the rate of said integrator with engine speed, the improvement comprising:

said integrator comprising a multi-bit binary up/-down counter circuit;

clock input, up/down control, output, and clock inhibit terminals associated with said counter circuit;

said counter circuit comprising means for algebraically summing clock pulses applied to the clock input in accordance with an up/down control signal applied to the up/down control and developing at the output an output signal representing the integrator signal;

said counter circuit further comprising means preventing clock pulses at the clock input from being algebraically summed whenever a clock inhibit signal is being applied to the clock inhibit and causing the count to be thereby held at the value existing just prior to the application of the clock inhibit signal to the clock inhibit;

means supplying clock pulses to the clock input at a rate correlated with engine speed;

means coupling said sensing means with the up/down control such that the rectangular waveform signal forms an up/down control signal which controls algebraic summation of clock pulses by said counter circuit;

and means for selectively interrupting closed-loop operation of the control in favor of an open-loop mode of operation comprising means providing an open-loop command signal in response to a predetermined condition for which closed-loop operation is to be interrupted and means responsive to said open-loop command signal causing a clock inhibit signal to be applied to the clock inhibit which in turn causes the count in the counter circuit, and hence the integrator signal, to be held at the value existing just prior to the occurrence of the open-loop command signal.

* * * * *